US005749346A

United States Patent [19]

Halvorson et al.

[11] Patent Number: 5,749,346

[45] Date of Patent: May 12, 1998

[54] ELECTRONIC CONTROL UNIT FOR CONTROLLING AN ELECTRONIC INJECTOR FUEL DELIVERY SYSTEM AND METHOD OF CONTROLLING AN ELECTRONIC INJECTOR FUEL DELIVERY SYSTEM

[75] Inventors: Todd Halvorson, Ft. Lauderdale, Fla.; Stephen R. Bickham, Bay City, Mich.; David Cutler, Plantation, Fla.

[73] Assignee: Hirel Holdings, Inc., Pompano Beach, Fla.

[21] Appl. No.: 393,315

[22] Filed: Feb. 23, 1995

[51] Int. Cl.[6] ..... F02M 51/00

[52] U.S. Cl. ..... 123/486

[58] Field of Search ..... 123/486, 480; 364/431.04, 431.05

[56] References Cited

U.S. PATENT DOCUMENTS

| | | | |
|---|---|---|---|
| 4,084,240 | 4/1978 | Lappington | 425/364 |
| 4,172,433 | 10/1979 | Bianchi et al. . | |
| 4,306,529 | 12/1981 | Chiesa et al. | 440/123 |
| 4,348,729 | 9/1982 | Sasayama et al. . | |
| 4,366,541 | 12/1982 | Mouri et al. . | |
| 4,445,481 | 5/1984 | Aoki et al. | 440/123 |
| 4,542,730 | 9/1985 | Nagasawa et al. | 489/123 |
| 4,545,355 | 10/1985 | Takao et al. | 489/123 |
| 4,570,599 | 2/1986 | Hasegawa et al. | 489/123 |
| 4,594,985 | 6/1986 | Fujimura et al. | 489/123 |
| 4,646,697 | 3/1987 | Grob et al. | 436/123 |
| 4,677,558 | 6/1987 | Böhmler et al. . | |
| 4,703,430 | 10/1987 | Amano et al. . | |
| 4,730,256 | 3/1988 | Niimi et al. . | |
| 4,741,312 | 5/1988 | Ohishi | 489/123 |
| 4,751,633 | 6/1988 | Henn et al. | 200/364 |
| 4,771,753 | 9/1988 | Ohishi | 489/123 |
| 4,789,939 | 12/1988 | Hamburg . | |
| 4,862,855 | 9/1989 | Manaka et al. | 489/123 |
| 4,907,558 | 3/1990 | Manaka et al. | 489/123 |
| 4,908,792 | 3/1990 | Przybyla et al. | 900/364 |
| 4,999,781 | 3/1991 | Holl et al. . | |
| 5,019,989 | 5/1991 | Ueda et al. | 364/431.05 |
| 5,033,437 | 7/1991 | Hori et al. | 489/123 |
| 5,091,858 | 2/1992 | Paielli . | |
| 5,243,951 | 9/1993 | Nakaniwa | 674/123 |
| 5,293,317 | 3/1994 | Adrain et al. . | |
| 5,297,046 | 3/1994 | Nakaniwa . | |
| 5,341,785 | 8/1994 | Meaney | 452/123 |
| 5,361,582 | 11/1994 | Uchida et al. | 276/60 |
| 5,375,577 | 12/1994 | Betts, Jr. et al. | 123/480 |
| 5,439,933 | 8/1995 | Hasegawa et al. | 123/486 |
| 5,446,665 | 8/1995 | Adrian et al. | 364/431.04 |
| 5,540,205 | 7/1996 | Davis et al. | 123/486 |

FOREIGN PATENT DOCUMENTS

| | | |
|---|---|---|
| 55-162104 | 12/1980 | Japan . |

*Primary Examiner*—Raymond A. Nelli

*Attorney, Agent, or Firm*—A. Jose Cortina; John T. Winburn

[57] ABSTRACT

A method and apparatus are disclosed for controlling operation of a spark-ignited internal combustion engine by adjusting pulse width of fuel injected into the engine. An initial fuel pulse width is set for respective pairs of engine operating parameters such as engine speed and manifold pressure. The pulse width is adjusted by a control, for each pair of parameters, to obtain maximum performance, for example, as indicated by a torque detector. Each time a pulse width is adjusted, all previously adjusted pulse widths are compared with corresponding pulse widths in stored template fuel maps. The best matched template fuel map is then used in conjunction with all previously adjusted points to create a new operational fuel map to run the engine until a more updated operational fuel map can be created upon additional fuel pulse widths being tuned.

40 Claims, 26 Drawing Sheets

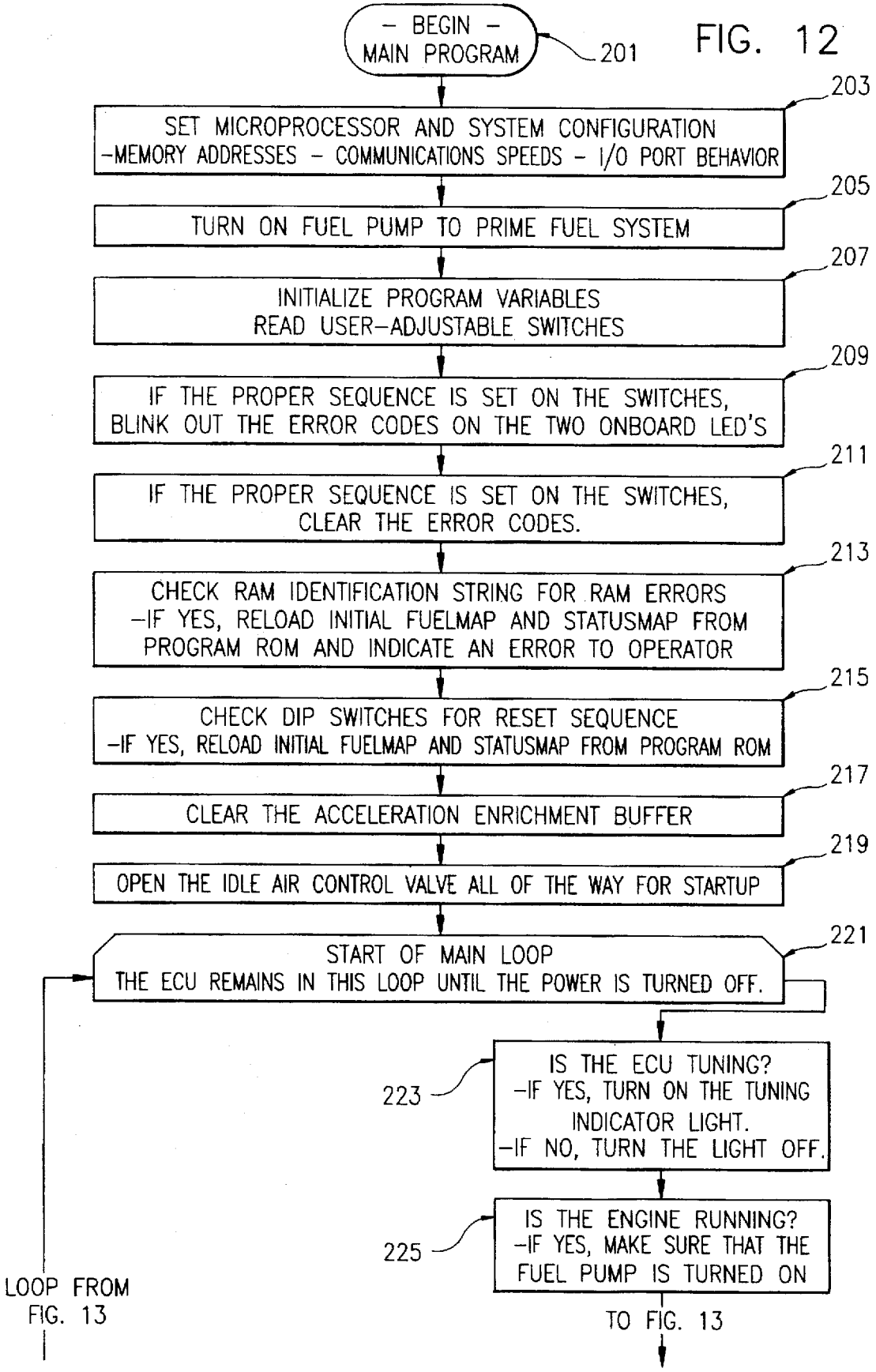
FIG. 12
- BEGIN -
MAIN PROGRAM
201
203
SET MICROPROCESSOR AND SYSTEM CONFIGURATION
-MEMORY ADDRESSES - COMMUNICATIONS SPEEDS - I/O PORT BEHAVIOR
205
TURN ON FUEL PUMP TO PRIME FUEL SYSTEM
207
INITIALIZE PROGRAM VARIABLES
READ USER-ADJUSTABLE SWITCHES
209
IF THE PROPER SEQUENCE IS SET ON THE SWITCHES,
BLINK OUT THE ERROR CODES ON THE TWO ONBOARD LED'S
211
IF THE PROPER SEQUENCE IS SET ON THE SWITCHES,
CLEAR THE ERROR CODES.
213
CHECK RAM IDENTIFICATION STRING FOR RAM ERRORS
-IF YES, RELOAD INITIAL FUELMAP AND STATUSMAP FROM
PROGRAM ROM AND INDICATE AN ERROR TO OPERATOR
215
CHECK DIP SWITCHES FOR RESET SEQUENCE
-IF YES, RELOAD INITIAL FUELMAP AND STATUSMAP FROM PROGRAM ROM
217
CLEAR THE ACCELERATION ENRICHMENT BUFFER
219
OPEN THE IDLE AIR CONTROL VALVE ALL OF THE WAY FOR STARTUP
221
START OF MAIN LOOP
THE ECU REMAINS IN THIS LOOP UNTIL THE POWER IS TURNED OFF.
223
IS THE ECU TUNING?
-IF YES, TURN ON THE TUNING
INDICATOR LIGHT.
-IF NO, TURN THE LIGHT OFF.
225
IS THE ENGINE RUNNING?
-IF YES, MAKE SURE THAT THE
FUEL PUMP IS TURNED ON
LOOP FROM
FIG. 13
TO FIG. 13

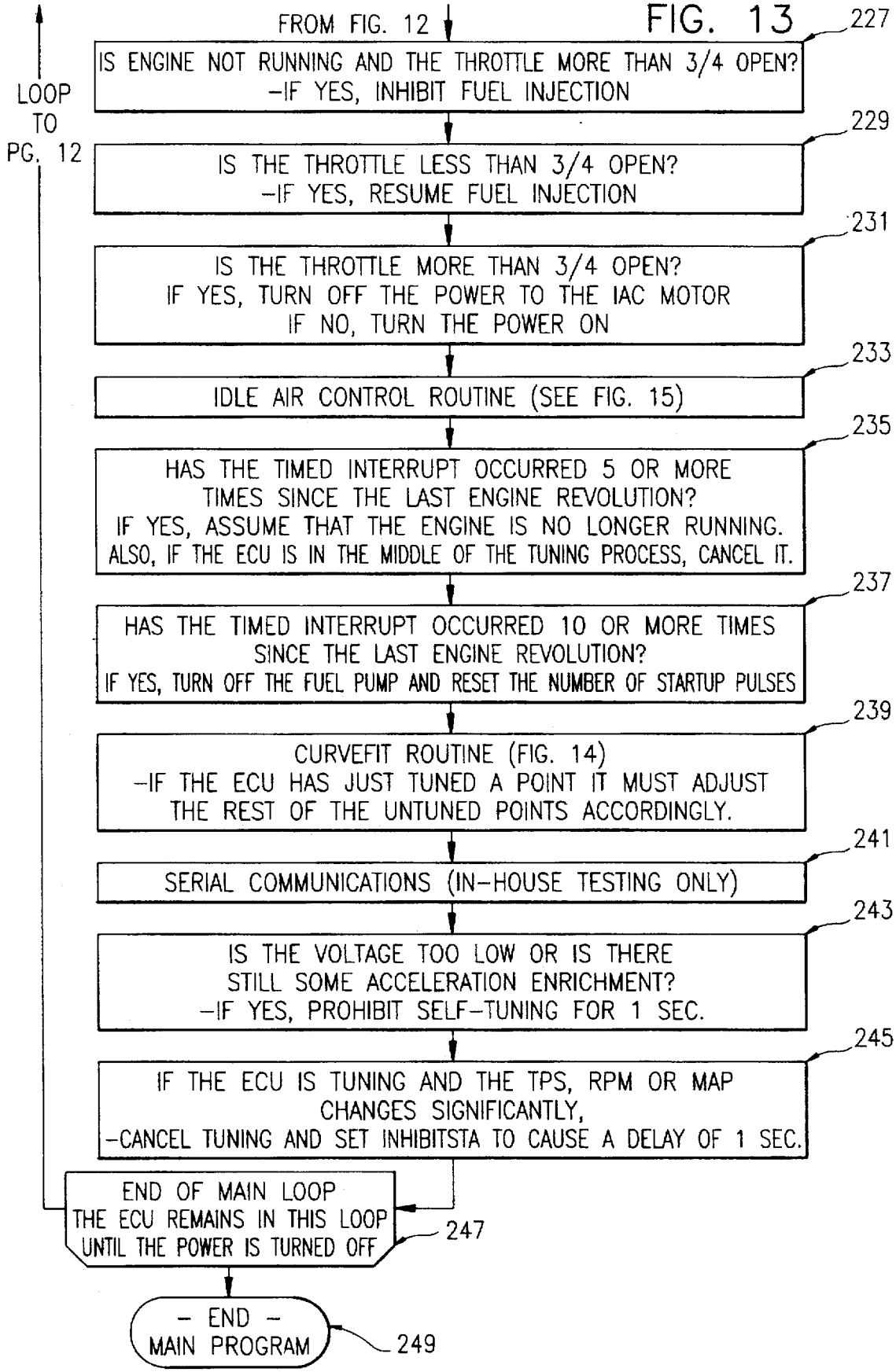
FROM FIG. 12
FIG. 13
227
IS ENGINE NOT RUNNING AND THE THROTTLE MORE THAN 3/4 OPEN?
-IF YES, INHIBIT FUEL INJECTION
LOOP TO PG. 12
229
IS THE THROTTLE LESS THAN 3/4 OPEN?
-IF YES, RESUME FUEL INJECTION
231
IS THE THROTTLE MORE THAN 3/4 OPEN?
IF YES, TURN OFF THE POWER TO THE IAC MOTOR
IF NO, TURN THE POWER ON
233
IDLE AIR CONTROL ROUTINE (SEE FIG. 15)
235
HAS THE TIMED INTERRUPT OCCURRED 5 OR MORE TIMES SINCE THE LAST ENGINE REVOLUTION?
IF YES, ASSUME THAT THE ENGINE IS NO LONGER RUNNING.
ALSO, IF THE ECU IS IN THE MIDDLE OF THE TUNING PROCESS, CANCEL IT.
237
HAS THE TIMED INTERRUPT OCCURRED 10 OR MORE TIMES SINCE THE LAST ENGINE REVOLUTION?
IF YES, TURN OFF THE FUEL PUMP AND RESET THE NUMBER OF STARTUP PULSES
239
CURVEFIT ROUTINE (FIG. 14)
-IF THE ECU HAS JUST TUNED A POINT IT MUST ADJUST THE REST OF THE UNTUNED POINTS ACCORDINGLY.
241
SERIAL COMMUNICATIONS (IN-HOUSE TESTING ONLY)
243
IS THE VOLTAGE TOO LOW OR IS THERE STILL SOME ACCELERATION ENRICHMENT?
-IF YES, PROHIBIT SELF-TUNING FOR 1 SEC.
245
IF THE ECU IS TUNING AND THE TPS, RPM OR MAP CHANGES SIGNIFICANTLY,
-CANCEL TUNING AND SET INHIBITSTA TO CAUSE A DELAY OF 1 SEC.
END OF MAIN LOOP
THE ECU REMAINS IN THIS LOOP UNTIL THE POWER IS TURNED OFF
247
- END -
MAIN PROGRAM
249

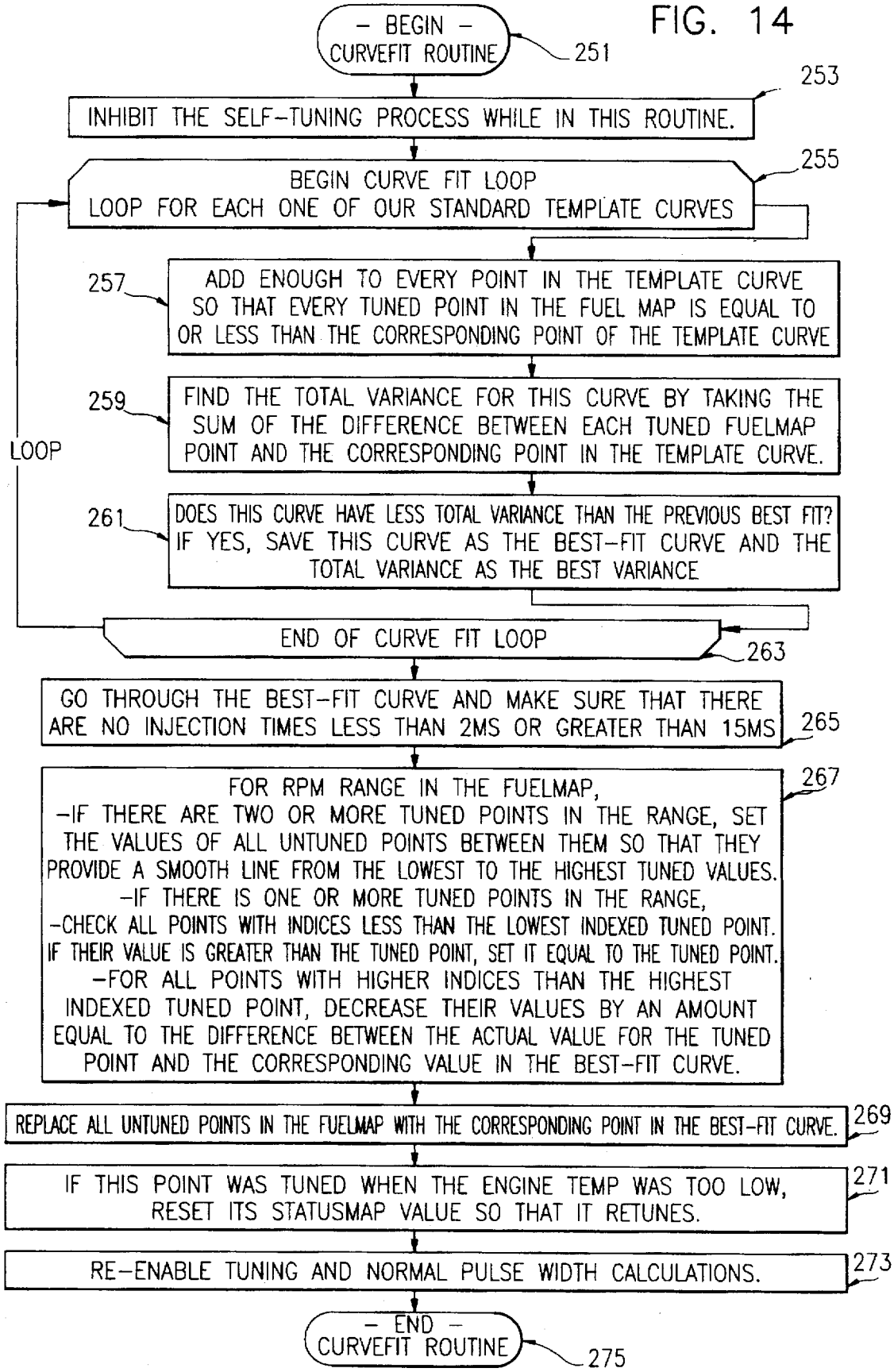
FIG. 14
- BEGIN - CURVEFIT ROUTINE
251
INHIBIT THE SELF-TUNING PROCESS WHILE IN THIS ROUTINE.
253
BEGIN CURVE FIT LOOP
LOOP FOR EACH ONE OF OUR STANDARD TEMPLATE CURVES
255
257
ADD ENOUGH TO EVERY POINT IN THE TEMPLATE CURVE SO THAT EVERY TUNED POINT IN THE FUEL MAP IS EQUAL TO OR LESS THAN THE CORRESPONDING POINT OF THE TEMPLATE CURVE
259
FIND THE TOTAL VARIANCE FOR THIS CURVE BY TAKING THE SUM OF THE DIFFERENCE BETWEEN EACH TUNED FUELMAP POINT AND THE CORRESPONDING POINT IN THE TEMPLATE CURVE.
LOOP
261
DOES THIS CURVE HAVE LESS TOTAL VARIANCE THAN THE PREVIOUS BEST FIT? IF YES, SAVE THIS CURVE AS THE BEST-FIT CURVE AND THE TOTAL VARIANCE AS THE BEST VARIANCE
END OF CURVE FIT LOOP
263
GO THROUGH THE BEST-FIT CURVE AND MAKE SURE THAT THERE ARE NO INJECTION TIMES LESS THAN 2MS OR GREATER THAN 15MS
265
FOR RPM RANGE IN THE FUELMAP,
-IF THERE ARE TWO OR MORE TUNED POINTS IN THE RANGE, SET THE VALUES OF ALL UNTUNED POINTS BETWEEN THEM SO THAT THEY PROVIDE A SMOOTH LINE FROM THE LOWEST TO THE HIGHEST TUNED VALUES.
-IF THERE IS ONE OR MORE TUNED POINTS IN THE RANGE,
-CHECK ALL POINTS WITH INDICES LESS THAN THE LOWEST INDEXED TUNED POINT. IF THEIR VALUE IS GREATER THAN THE TUNED POINT, SET IT EQUAL TO THE TUNED POINT.
-FOR ALL POINTS WITH HIGHER INDICES THAN THE HIGHEST INDEXED TUNED POINT, DECREASE THEIR VALUES BY AN AMOUNT EQUAL TO THE DIFFERENCE BETWEEN THE ACTUAL VALUE FOR THE TUNED POINT AND THE CORRESPONDING VALUE IN THE BEST-FIT CURVE.
267
REPLACE ALL UNTUNED POINTS IN THE FUELMAP WITH THE CORRESPONDING POINT IN THE BEST-FIT CURVE.
269
IF THIS POINT WAS TUNED WHEN THE ENGINE TEMP WAS TOO LOW, RESET ITS STATUSMAP VALUE SO THAT IT RETUNES.
271
RE-ENABLE TUNING AND NORMAL PULSE WIDTH CALCULATIONS.
273
- END - CURVEFIT ROUTINE
275

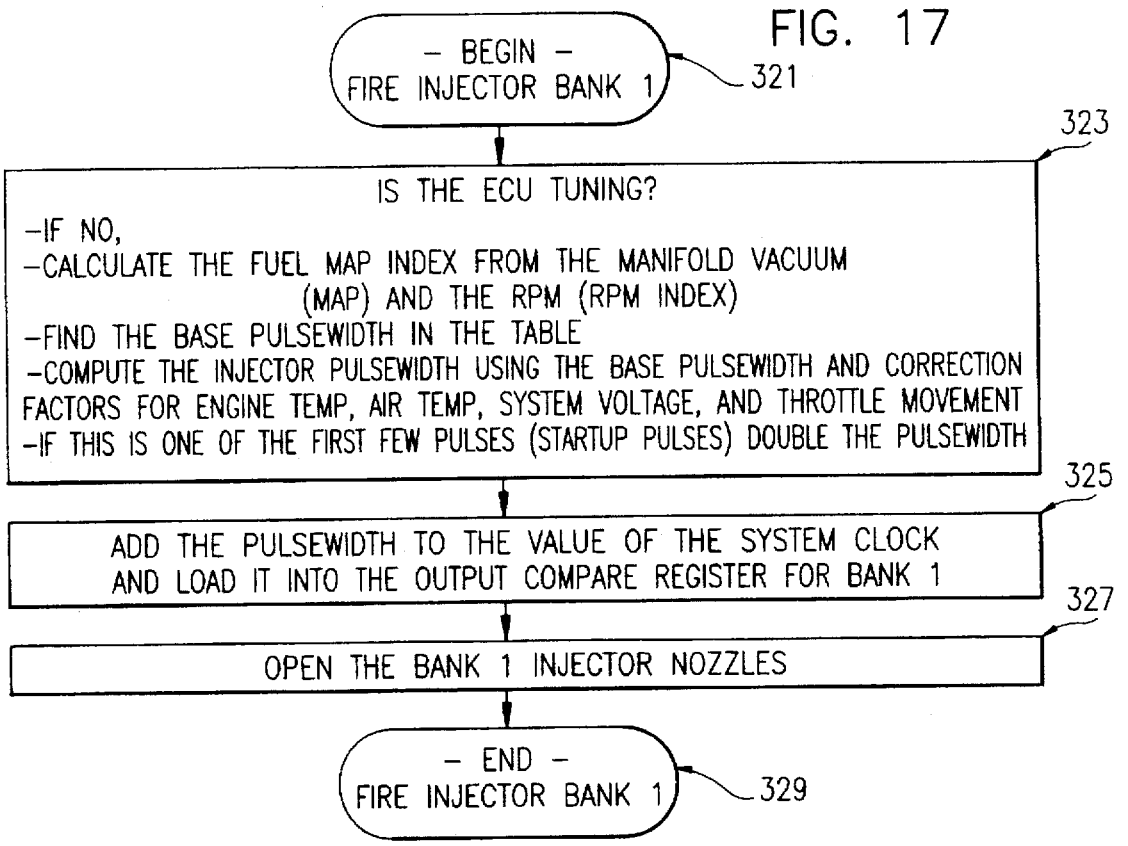
FIG. 17
- BEGIN -
FIRE INJECTOR BANK 1
321
323
IS THE ECU TUNING?
-IF NO,
-CALCULATE THE FUEL MAP INDEX FROM THE MANIFOLD VACUUM (MAP) AND THE RPM (RPM INDEX)
-FIND THE BASE PULSEWIDTH IN THE TABLE
-COMPUTE THE INJECTOR PULSEWIDTH USING THE BASE PULSEWIDTH AND CORRECTION FACTORS FOR ENGINE TEMP, AIR TEMP, SYSTEM VOLTAGE, AND THROTTLE MOVEMENT
-IF THIS IS ONE OF THE FIRST FEW PULSES (STARTUP PULSES) DOUBLE THE PULSEWIDTH
325
ADD THE PULSEWIDTH TO THE VALUE OF THE SYSTEM CLOCK AND LOAD IT INTO THE OUTPUT COMPARE REGISTER FOR BANK 1
327
OPEN THE BANK 1 INJECTOR NOZZLES
- END -
FIRE INJECTOR BANK 1
329

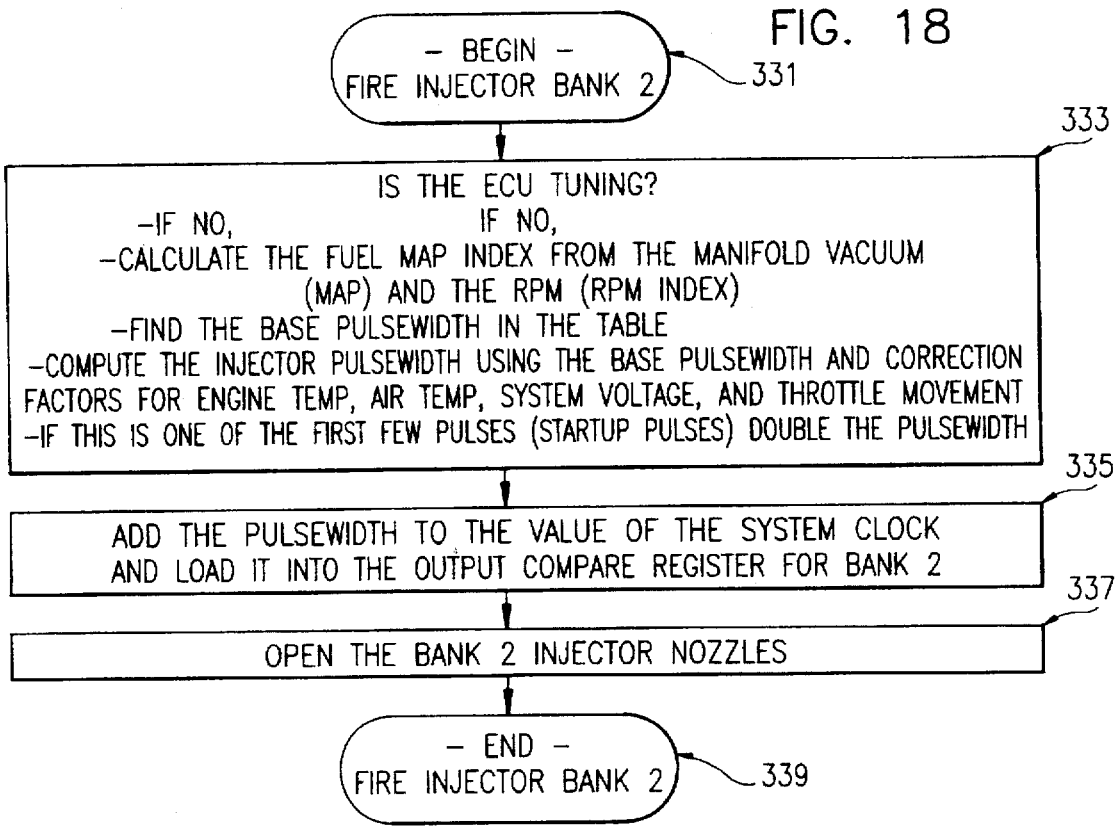
FIG. 18
- BEGIN -
FIRE INJECTOR BANK 2
331
333
IS THE ECU TUNING?
-IF NO,
IF NO,
-CALCULATE THE FUEL MAP INDEX FROM THE MANIFOLD VACUUM (MAP) AND THE RPM (RPM INDEX)
-FIND THE BASE PULSEWIDTH IN THE TABLE
-COMPUTE THE INJECTOR PULSEWIDTH USING THE BASE PULSEWIDTH AND CORRECTION FACTORS FOR ENGINE TEMP, AIR TEMP, SYSTEM VOLTAGE, AND THROTTLE MOVEMENT
-IF THIS IS ONE OF THE FIRST FEW PULSES (STARTUP PULSES) DOUBLE THE PULSEWIDTH
335
ADD THE PULSEWIDTH TO THE VALUE OF THE SYSTEM CLOCK AND LOAD IT INTO THE OUTPUT COMPARE REGISTER FOR BANK 2
337
OPEN THE BANK 2 INJECTOR NOZZLES
- END -
FIRE INJECTOR BANK 2
339

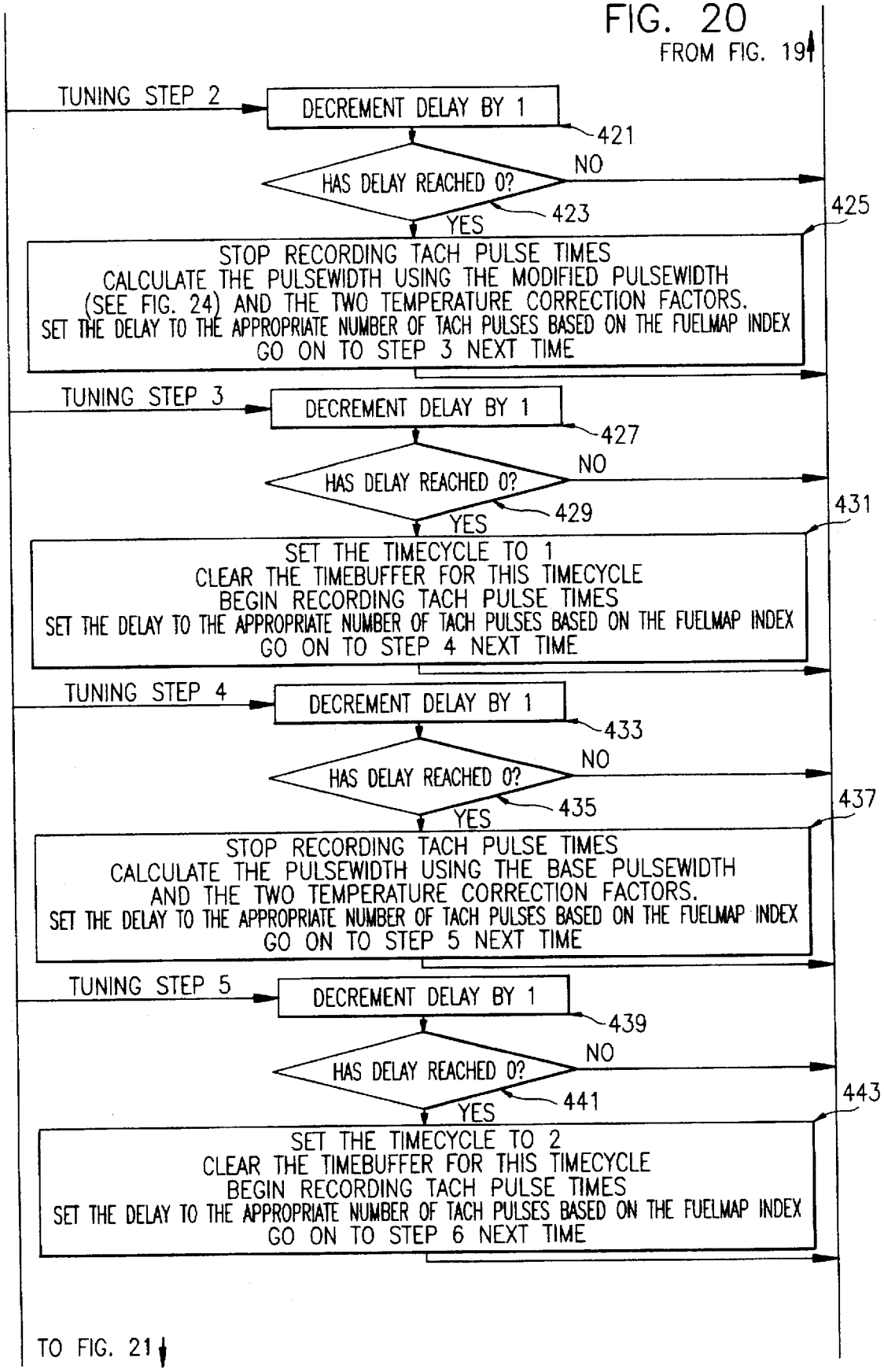
FIG. 20
FROM FIG. 19
TUNING STEP 2
DECREMENT DELAY BY 1
421
HAS DELAY REACHED 0?
NO
YES
423
425
STOP RECORDING TACH PULSE TIMES
CALCULATE THE PULSEWIDTH USING THE MODIFIED PULSEWIDTH
(SEE FIG. 24) AND THE TWO TEMPERATURE CORRECTION FACTORS.
SET THE DELAY TO THE APPROPRIATE NUMBER OF TACH PULSES BASED ON THE FUELMAP INDEX
GO ON TO STEP 3 NEXT TIME
TUNING STEP 3
DECREMENT DELAY BY 1
427
HAS DELAY REACHED 0?
NO
YES
429
431
SET THE TIMECYCLE TO 1
CLEAR THE TIMEBUFFER FOR THIS TIMECYCLE
BEGIN RECORDING TACH PULSE TIMES
SET THE DELAY TO THE APPROPRIATE NUMBER OF TACH PULSES BASED ON THE FUELMAP INDEX
GO ON TO STEP 4 NEXT TIME
TUNING STEP 4
DECREMENT DELAY BY 1
433
HAS DELAY REACHED 0?
NO
YES
435
437
STOP RECORDING TACH PULSE TIMES
CALCULATE THE PULSEWIDTH USING THE BASE PULSEWIDTH
AND THE TWO TEMPERATURE CORRECTION FACTORS.
SET THE DELAY TO THE APPROPRIATE NUMBER OF TACH PULSES BASED ON THE FUELMAP INDEX
GO ON TO STEP 5 NEXT TIME
TUNING STEP 5
DECREMENT DELAY BY 1
439
HAS DELAY REACHED 0?
NO
YES
441
443
SET THE TIMECYCLE TO 2
CLEAR THE TIMEBUFFER FOR THIS TIMECYCLE
BEGIN RECORDING TACH PULSE TIMES
SET THE DELAY TO THE APPROPRIATE NUMBER OF TACH PULSES BASED ON THE FUELMAP INDEX
GO ON TO STEP 6 NEXT TIME
TO FIG. 21

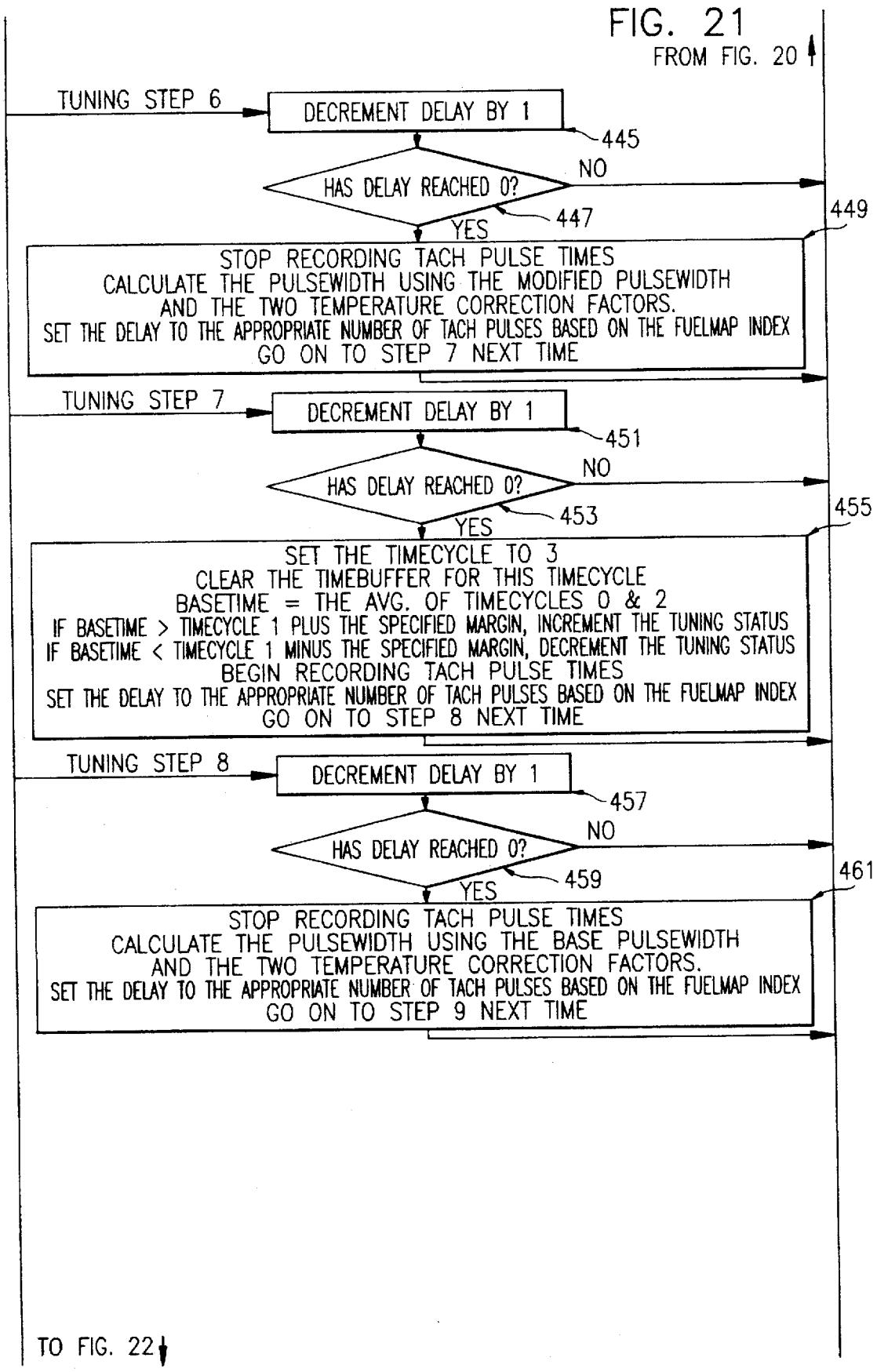
FIG. 21
FROM FIG. 20
TUNING STEP 6
DECREMENT DELAY BY 1
445
HAS DELAY REACHED 0?
NO
YES
447
449
STOP RECORDING TACH PULSE TIMES
CALCULATE THE PULSEWIDTH USING THE MODIFIED PULSEWIDTH
AND THE TWO TEMPERATURE CORRECTION FACTORS.
SET THE DELAY TO THE APPROPRIATE NUMBER OF TACH PULSES BASED ON THE FUELMAP INDEX
GO ON TO STEP 7 NEXT TIME
TUNING STEP 7
DECREMENT DELAY BY 1
451
HAS DELAY REACHED 0?
NO
YES
453
455
SET THE TIMECYCLE TO 3
CLEAR THE TIMEBUFFER FOR THIS TIMECYCLE
BASETIME = THE AVG. OF TIMECYCLES 0 & 2
IF BASETIME > TIMECYCLE 1 PLUS THE SPECIFIED MARGIN, INCREMENT THE TUNING STATUS
IF BASETIME < TIMECYCLE 1 MINUS THE SPECIFIED MARGIN, DECREMENT THE TUNING STATUS
BEGIN RECORDING TACH PULSE TIMES
SET THE DELAY TO THE APPROPRIATE NUMBER OF TACH PULSES BASED ON THE FUELMAP INDEX
GO ON TO STEP 8 NEXT TIME
TUNING STEP 8
DECREMENT DELAY BY 1
457
HAS DELAY REACHED 0?
NO
YES
459
461
STOP RECORDING TACH PULSE TIMES
CALCULATE THE PULSEWIDTH USING THE BASE PULSEWIDTH
AND THE TWO TEMPERATURE CORRECTION FACTORS.
SET THE DELAY TO THE APPROPRIATE NUMBER OF TACH PULSES BASED ON THE FUELMAP INDEX
GO ON TO STEP 9 NEXT TIME
TO FIG. 22

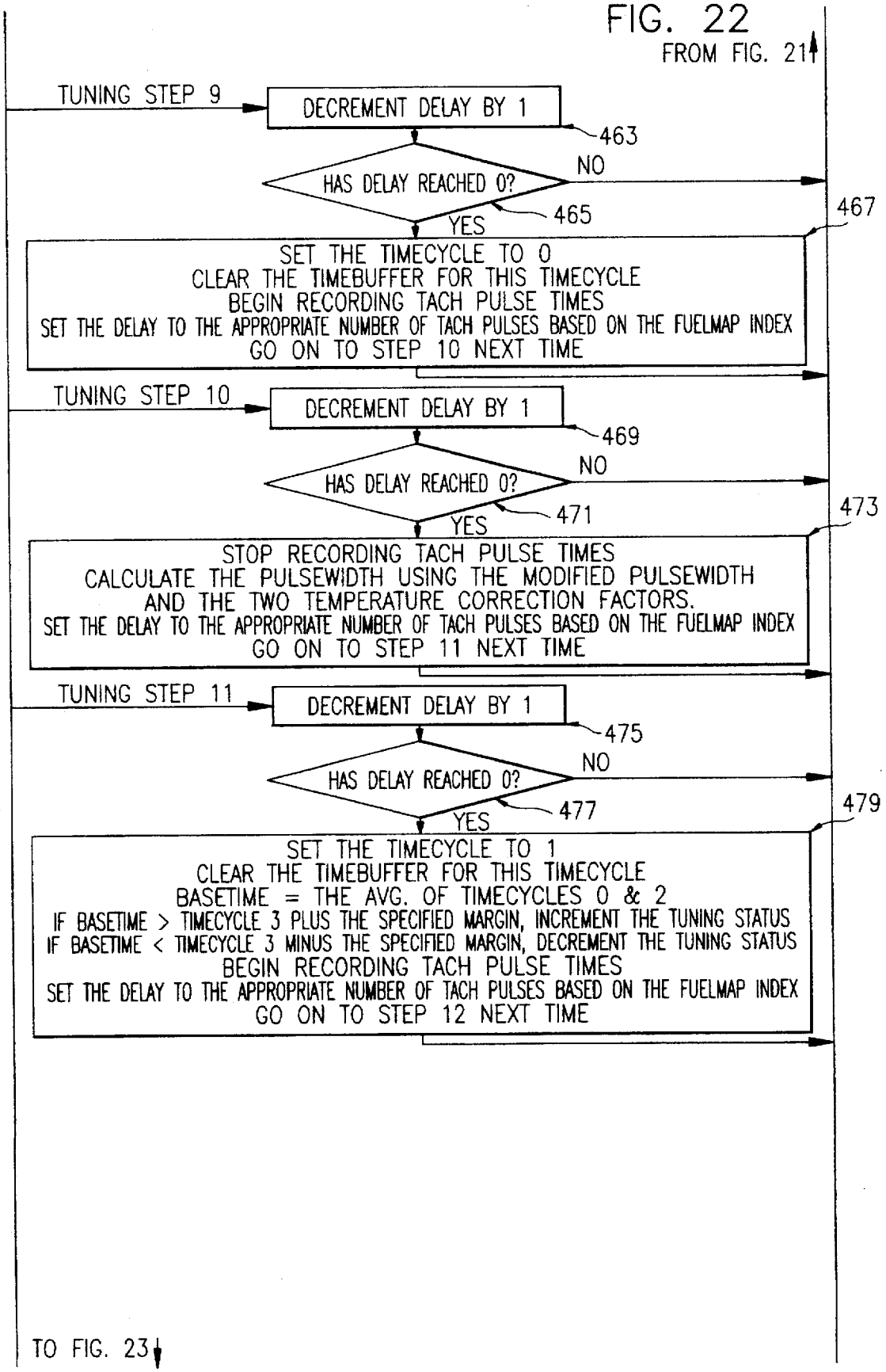
FIG. 22
FROM FIG. 21
TUNING STEP 9
DECREMENT DELAY BY 1
463
HAS DELAY REACHED 0?
NO
465
YES
467
SET THE TIMECYCLE TO 0
CLEAR THE TIMEBUFFER FOR THIS TIMECYCLE
BEGIN RECORDING TACH PULSE TIMES
SET THE DELAY TO THE APPROPRIATE NUMBER OF TACH PULSES BASED ON THE FUELMAP INDEX
GO ON TO STEP 10 NEXT TIME
TUNING STEP 10
DECREMENT DELAY BY 1
469
HAS DELAY REACHED 0?
NO
471
YES
473
STOP RECORDING TACH PULSE TIMES
CALCULATE THE PULSEWIDTH USING THE MODIFIED PULSEWIDTH
AND THE TWO TEMPERATURE CORRECTION FACTORS.
SET THE DELAY TO THE APPROPRIATE NUMBER OF TACH PULSES BASED ON THE FUELMAP INDEX
GO ON TO STEP 11 NEXT TIME
TUNING STEP 11
DECREMENT DELAY BY 1
475
HAS DELAY REACHED 0?
NO
477
YES
479
SET THE TIMECYCLE TO 1
CLEAR THE TIMEBUFFER FOR THIS TIMECYCLE
BASETIME = THE AVG. OF TIMECYCLES 0 & 2
IF BASETIME > TIMECYCLE 3 PLUS THE SPECIFIED MARGIN, INCREMENT THE TUNING STATUS
IF BASETIME < TIMECYCLE 3 MINUS THE SPECIFIED MARGIN, DECREMENT THE TUNING STATUS
BEGIN RECORDING TACH PULSE TIMES
SET THE DELAY TO THE APPROPRIATE NUMBER OF TACH PULSES BASED ON THE FUELMAP INDEX
GO ON TO STEP 12 NEXT TIME
TO FIG. 23

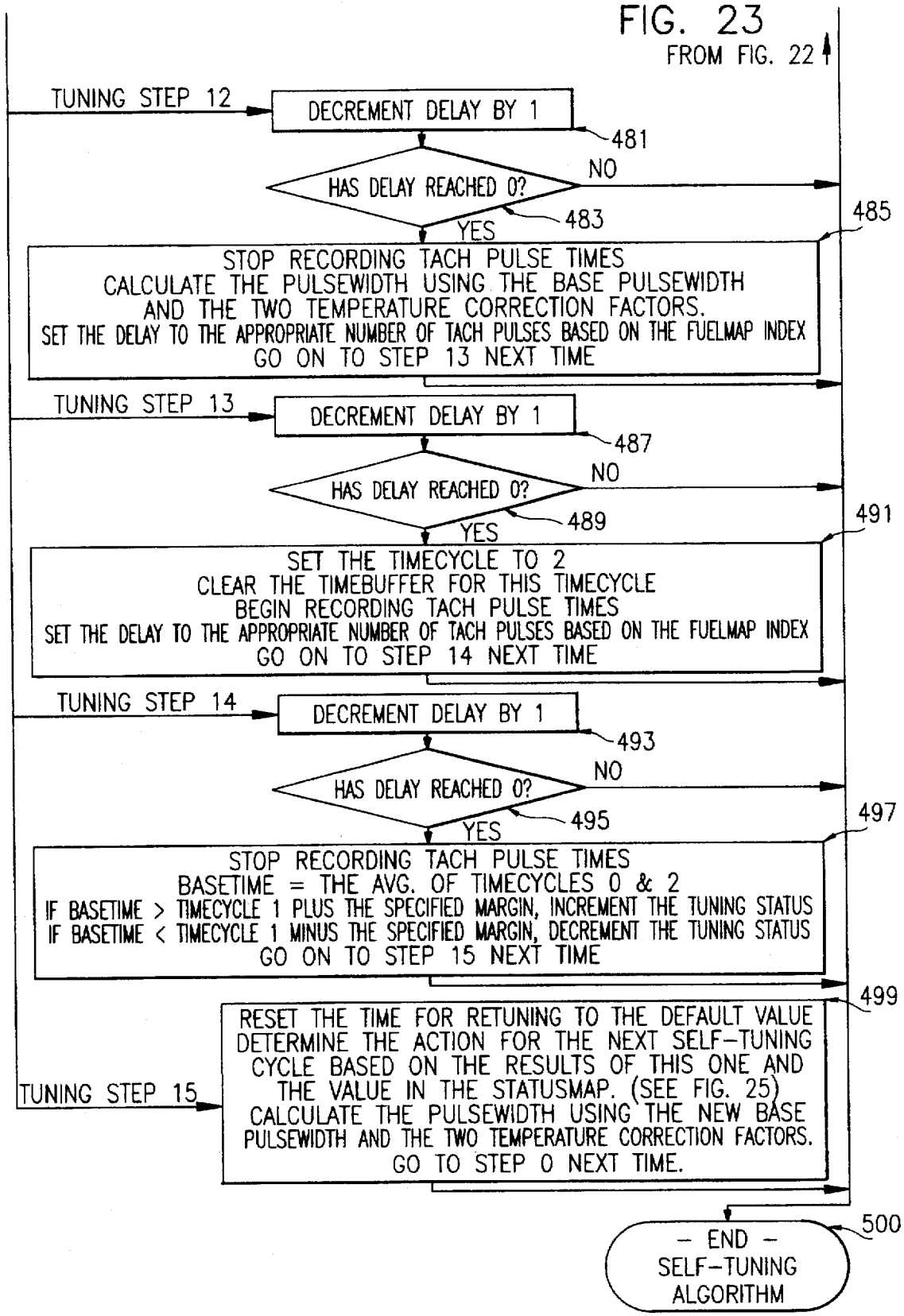
FIG. 23
FROM FIG. 22
TUNING STEP 12
DECREMENT DELAY BY 1
481
HAS DELAY REACHED 0?
NO
YES
483
485
STOP RECORDING TACH PULSE TIMES
CALCULATE THE PULSEWIDTH USING THE BASE PULSEWIDTH
AND THE TWO TEMPERATURE CORRECTION FACTORS.
SET THE DELAY TO THE APPROPRIATE NUMBER OF TACH PULSES BASED ON THE FUELMAP INDEX
GO ON TO STEP 13 NEXT TIME
TUNING STEP 13
DECREMENT DELAY BY 1
487
HAS DELAY REACHED 0?
NO
YES
489
491
SET THE TIMECYCLE TO 2
CLEAR THE TIMEBUFFER FOR THIS TIMECYCLE
BEGIN RECORDING TACH PULSE TIMES
SET THE DELAY TO THE APPROPRIATE NUMBER OF TACH PULSES BASED ON THE FUELMAP INDEX
GO ON TO STEP 14 NEXT TIME
TUNING STEP 14
DECREMENT DELAY BY 1
493
HAS DELAY REACHED 0?
NO
YES
495
497
STOP RECORDING TACH PULSE TIMES
BASETIME = THE AVG. OF TIMECYCLES 0 & 2
IF BASETIME > TIMECYCLE 1 PLUS THE SPECIFIED MARGIN, INCREMENT THE TUNING STATUS
IF BASETIME < TIMECYCLE 1 MINUS THE SPECIFIED MARGIN, DECREMENT THE TUNING STATUS
GO ON TO STEP 15 NEXT TIME
499
TUNING STEP 15
RESET THE TIME FOR RETUNING TO THE DEFAULT VALUE
DETERMINE THE ACTION FOR THE NEXT SELF-TUNING
CYCLE BASED ON THE RESULTS OF THIS ONE AND
THE VALUE IN THE STATUSMAP. (SEE FIG. 25)
CALCULATE THE PULSEWIDTH USING THE NEW BASE
PULSEWIDTH AND THE TWO TEMPERATURE CORRECTION FACTORS.
GO TO STEP 0 NEXT TIME.
500
- END -
SELF-TUNING
ALGORITHM

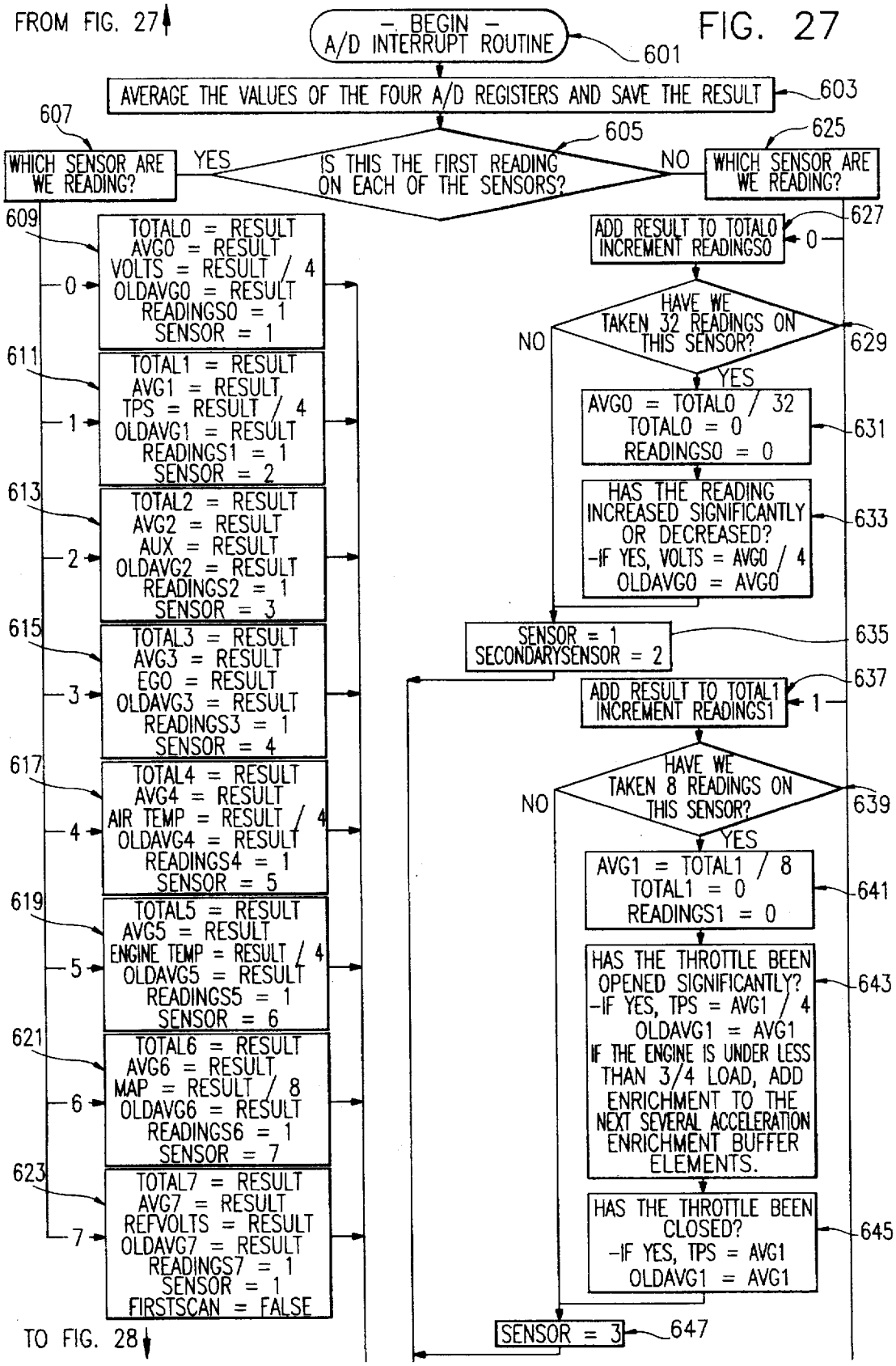
FROM FIG. 27
- BEGIN -
A/D INTERRUPT ROUTINE
601
FIG. 27
AVERAGE THE VALUES OF THE FOUR A/D REGISTERS AND SAVE THE RESULT
603
605
IS THIS THE FIRST READING ON EACH OF THE SENSORS?
YES
NO
607
WHICH SENSOR ARE WE READING?
625
WHICH SENSOR ARE WE READING?
609
TOTAL0 = RESULT
AVG0 = RESULT
VOLTS = RESULT / 4
OLDAVG0 = RESULT
READINGS0 = 1
SENSOR = 1
611
TOTAL1 = RESULT
AVG1 = RESULT
TPS = RESULT / 4
OLDAVG1 = RESULT
READINGS1 = 1
SENSOR = 2
613
TOTAL2 = RESULT
AVG2 = RESULT
AUX = RESULT
OLDAVG2 = RESULT
READINGS2 = 1
SENSOR = 3
615
TOTAL3 = RESULT
AVG3 = RESULT
EGO = RESULT
OLDAVG3 = RESULT
READINGS3 = 1
SENSOR = 4
617
TOTAL4 = RESULT
AVG4 = RESULT
AIR TEMP = RESULT / 4
OLDAVG4 = RESULT
READINGS4 = 1
SENSOR = 5
619
TOTAL5 = RESULT
AVG5 = RESULT
ENGINE TEMP = RESULT / 4
OLDAVG5 = RESULT
READINGS5 = 1
SENSOR = 6
621
TOTAL6 = RESULT
AVG6 = RESULT
MAP = RESULT / 8
OLDAVG6 = RESULT
READINGS6 = 1
SENSOR = 7
623
TOTAL7 = RESULT
AVG7 = RESULT
REFVOLTS = RESULT
OLDAVG7 = RESULT
READINGS7 = 1
SENSOR = 1
FIRSTSCAN = FALSE
TO FIG. 28
0
1
2
3
4
5
6
7
627
ADD RESULT TO TOTAL0
INCREMENT READINGS0
629
HAVE WE TAKEN 32 READINGS ON THIS SENSOR?
NO
YES
631
AVG0 = TOTAL0 / 32
TOTAL0 = 0
READINGS0 = 0
633
HAS THE READING INCREASED SIGNIFICANTLY OR DECREASED?
-IF YES, VOLTS = AVG0 / 4
OLDAVG0 = AVG0
635
SENSOR = 1
SECONDARYSENSOR = 2
637
ADD RESULT TO TOTAL1
INCREMENT READINGS1
639
HAVE WE TAKEN 8 READINGS ON THIS SENSOR?
NO
YES
641
AVG1 = TOTAL1 / 8
TOTAL1 = 0
READINGS1 = 0
643
HAS THE THROTTLE BEEN OPENED SIGNIFICANTLY?
-IF YES, TPS = AVG1 / 4
OLDAVG1 = AVG1
IF THE ENGINE IS UNDER LESS THAN 3/4 LOAD, ADD ENRICHMENT TO THE NEXT SEVERAL ACCELERATION ENRICHMENT BUFFER ELEMENTS.
645
HAS THE THROTTLE BEEN CLOSED?
-IF YES, TPS = AVG1
OLDAVG1 = AVG1
SENSOR = 3
647

FROM FIG. 27

TO FIG. 29

ELECTRONIC CONTROL UNIT FOR CONTROLLING AN ELECTRONIC INJECTOR FUEL DELIVERY SYSTEM AND METHOD OF CONTROLLING AN ELECTRONIC INJECTOR FUEL DELIVERY SYSTEM

BACKGROUND OF THE INVENTION

This invention relates to a self-programming electronic control unit for controlling operation of an electronic injector fuel delivery system, for example, of the type used on one or more cylinder internal combustion engines, particularly spark ignited (SI) internal combustion engines. The invention further relates to a method of controlling such electronic injector fuel delivery systems on such engines.

In control or regulation of SI internal combustion engines, computers and like computerized controllers are increasingly being used to enable the furnishing of precise control signals for individual fuel control elements, such as fuel injectors, especially with a view to obtaining optimum engine performance and minimal fuel consumption, with a consequent advantage being reduced toxic exhaust gas.

One prior art approach has involved improving the combustion timing of diesel or spark ignition (SI) engines. In such a system, a machine control parameter is oscillated (dithered) back and forth on either side of a given setting of the machine control parameter, with the period of the dithering being in synchronism with the natural cycle of the machine. Changes in the control system error signal due to normal speed changes of the machine are minimized or eliminated in this manner. When applied to a spark ignition of a gasoline engine or the injection timing on a diesel engine, the timing is advanced and retarded in synchronism with rotation of the engine's shaft such that each phase of the dither cycle includes an equal number of complete engine cycles. The problem with such a system is that it relies upon a somewhat random approach to dithering without providing real-time measurements and adjustments of critical parameters to result in optimum operation of the engine. Another disadvantage of this type of system is that the computer controlling it is already preprogrammed and there is limited ability to vary the parameters affecting operation of the system.

An alternative approach has involved generating a time-duration signal intended, in particular, for controlling fuel metering or ignition processes in an internal combustion engine. Such an approach has typically optimized around a time-duration signal formed in accordance with a fixed formula. The problem with such an approach is that it is not adaptive and cannot adjust for different engine operating parameters in a particular engine's operating profile.

Yet still another approach has involved controlling the air/fuel mixture delivered to an internal combustion engine to regulate what has been described as the "roughness" of the engine at a predetermined level. The control system receives as an input signal, a signal indicative of the engine roughness, and processes the signal to generate an output control signal for controlling the fuel delivery mechanism to operate the engine at the leanest possible air/fuel mixture ratio compatible with a predetermined level of engine roughness. Such a system is not adaptive to different types of engines and is, as noted above with respect to other systems, incapable of adjusting for different engine operating parameters throughout the life of the engine and for different operating conditions thereof.

More recently, it has been known to provide an engine fuel delivery control system in which the fuel injectors of the engine respond to electronic control signals for delivering fuel to the engine cylinders. A plurality of sensors apply electrical sensor signals indicative of various functions of engine operating conditions. An engine control unit includes an electronic memory which stores engine control parameters in tables. In a programming mode of operation, the engine operation is monitored with an external computer and, for example, engine gauges. The control parameters in the tables are varied as the engine is monitored with the external computer through which the control parameters are programmed by a knowledgeable operator using the computer as he observes the effects of parameter variation. The operator then makes further adjustments to thereby change the tables for regular engine operation. A problem with such a system, however, is that it requires providing service to the engine with an external operator who views the various variables of operation of the engine with some kind of input device, i.e., a computer. The input device is used to update the tables within the electronic control unit to optimize for the particular engine at that point in time. To remain accurate, this system requires periodic updating and removing the engine from regular operation, and the involvement of an external, knowledgeable operator. This operation requires time-consuming initial programming as well as periodic updating to account for engine changes over time.

In accordance with the invention, the problems of the prior art are avoided and there is provided an electronic control unit and method of controlling operation of an electronic fuel injection system for an SI internal combustion engine of one or more cylinders, which is self-programming and which continuously updates the fuel parameters supplied to the engine as a function of various sensed operating conditions of the engine in real-time. By the term "self-programming" is meant the ability of the system to construct a fuel table using predefined fuel metering tables in accordance with an established set of rules, and based upon sensed engine operation parameters, for operating a particular engine at peak performance. In this disclosure, the terms "fuel table(s)" or "fuel map(s)" refer to a database correlating injector pulse width to particular engine speed and load conditions.

SUMMARY OF THE INVENTION

In accordance with its broadest aspect the invention relates to a method and apparatus for controlling an electronic injector fuel delivery system. The method involves tuning an engine upon start up in accordance with an initial predetermined fuel map in which pairs of specific engine operating parameters have a specific injector pulse width value associated therewith. In a preferred aspect, the pair of parameters are engine speed, i.e., RPMs, and manifold intake pressure, i.e., MAP. The initial fuel map is set to operate for a broad range of engines without optimizing for a particular engine.

The pulse width for a particular pair of parameters is either increased or decreased by a specific value, e.g., 3%, 6%, or 12%, toward the rich side of operation of the engine. If no improvement in engine performance is indicated, for example, by a change in engine speed, or change in torque as measured in a dynamometer (an engine parameter), is noted, or if a decrease is noted, then the direction of adjustment is reversed in the opposite direction, i.e., one of lean or rich. Other ways of measuring performance change can include detecting change in engine sound, or change in manifold vacuum, etc., as will be readily apparent to those of ordinary skill in the art. Adjustment toward the lean side is likely to cause a drop more quickly than when adjusted toward the rich side, so that upon an initial drop after adjustment toward the lean side, the adjustment is then reversed one increment toward rich to arrive at optimum performance.

Preferably, if the initial adjustments are in sizes of 12%, then upon a move toward the rich side of one increment after a drop in performance, the next move toward lean can be 6% until a drop is seen. Reversal toward rich of 6% can then be followed by a move toward lean of 3%, etc., until an optimum is reached.

Upon at least two injector pulse widths being tuned for the initial fuel map, tuning is preferably inhibited, and the points tuned are compared to corresponding points with respective ones of a plurality predetermined template fuel maps, and a new fuel map is created based in part upon the closest template fuel map, for running the engine. Preferably, the matching is done by comparing pulse widths previously tuned and adding sufficient pulse width size to every point in the matched template fuel maps so that every tuned point in the original fuel map is equal to or less than the corresponding point of the current template fuel map being compared. The total variance for this template fuel map is obtained by taking the sum of the difference between each tuned pulse width and the corresponding pulse width in this template fuel map. It is then determined of the new fuel map resulting from each comparison above for each one of said plurality of fuel maps has less total variance than the new fuel map from each comparison. The lowest variance results in selection of the template fuel map to be used, to replace all untuned points in the operational fuel map. The tuned points remain as previously tuned in the operational fuel map.

Due to limitations of the currently used injectors, pulse width sizes are set at no greater than a specified value, e.g., 15 milliseconds, and no less than a specified value, e.g., 2 milliseconds.

At time of injection, the injected pulse widths are modified by predetermined correction factors for environmental conditions, i.e., air temperature, engine temperature, battery voltage, etc., as will be readily apparent to those of ordinary skill in the art.

In another aspect, the invention relates to an apparatus for conducting the above-described method. Appropriate means are provided in the context of a microprocessor based system, with appropriate sensors, to conduct the method.

BRIEF DESCRIPTION OF THE DRAWINGS

Having briefly described the invention, the same will become better understood from the following detailed discussion, taken in conjunction with reference to the attached drawings in which:

FIGS. 12 and 13 together make up a flow chart of the main program routine for implementing the system and method of the invention on an internal combustion engine;

FIG. 14 is a flow chart illustrating a routine previously for predicting untuned points based upon the results of having tuned a number of points;

FIGS. 17 and 18 are flow charts illustrating the start of injection of fuel, respectively, through first and second injector banks, each time one engine revolution is completed;

FIGS. 19–23 together constitute a flow chart illustrating how self-tuning is achieved with the system and method;

FIGS. 27–30 together constitute a flow chart showing operation of a time synchronized analog-to-digital (A/D) interrupt routine of the system and method of the invention.

DETAILED DISCUSSION OF THE INVENTION

Figure 1:
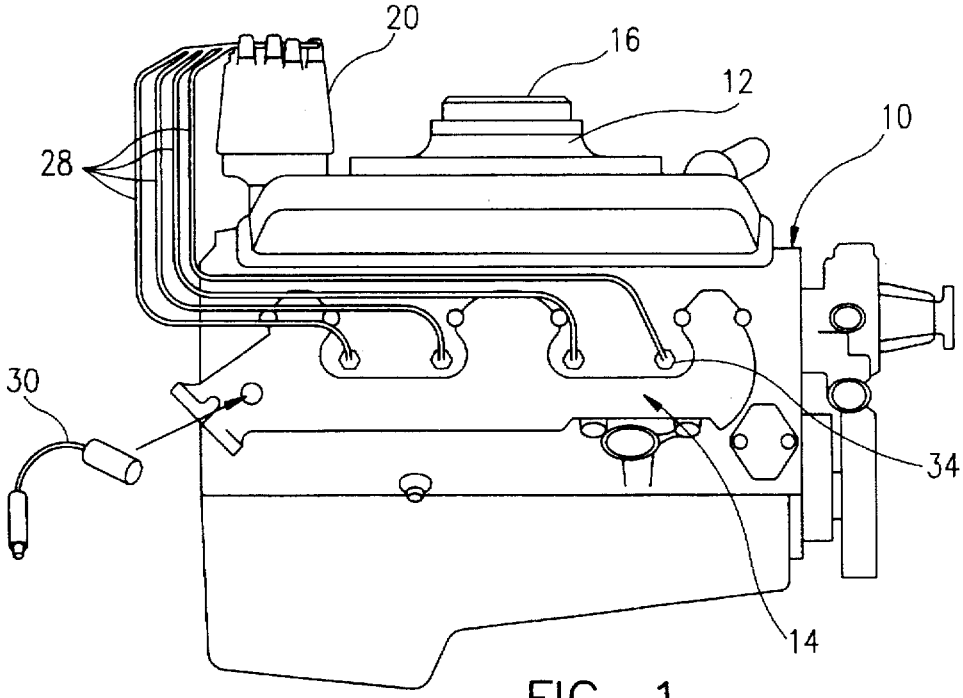
FIG. 1 is a schematic diagram in side view illustrating an internal combustion engine, in incomplete form, and illustrating various components and sensors thereof which are used in implementing the apparatus and method of the invention.
Figure 2:
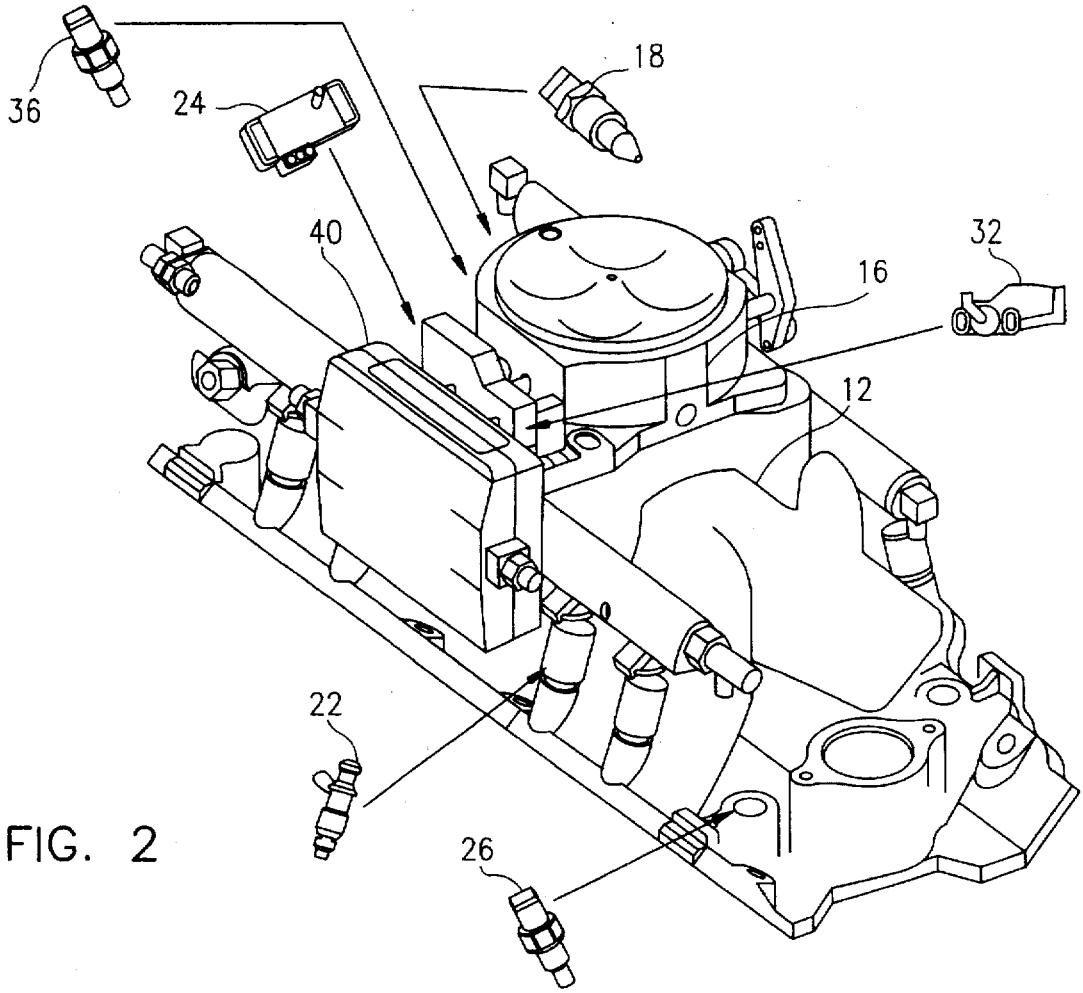
FIG. 2 is a partial perspective view, in exploded form, of the engine of FIG. 1 showing additional components not shown in FIG. 1.

FIGS. 1 and 2 illustrate, respectively, in exploded side view, and in exploded perspective view, a typical combustion engine 10 on which the electronic control unit 40 (FIG. 3) of the invention is implemented. The engine is typically an eight cylinder engine, although as will be readily apparent to those of ordinary skill in the art, can be any configuration of an internal SI combustion engine readily adaptable to the system.

The engine 10 includes an intake manifold 12 and an exhaust manifold 14 of conventional construction. An air intake valve 16 includes a throttle position sensor 32 for indicating throttle or valve position, and has a lead connected to the electronic control unit 40. The air intake valve 16 includes an idle air controller 18 of conventional construction for use upon initial start up to augment the amount of air fed to the air/fuel mixture during warm up of the engine and control idle speed for load variations when throttle blades are closed in a conventional manner. A distributor 20 has spark plug wires 28 leading to spark plugs 34 and includes means for detecting ignition pulses or some other signal indicative of engine speed, for example, an engine speed sensor 38 (not shown) for detecting revolutions per minute, RPMs, of the engine, and includes a lead connecting it to the electronic control unit 40 to provide a "tachometer" input for practicing the method in accordance with the invention. As will be appreciated by those of ordinary skill in the art, this is only one example of detecting engine speed, and a multitude of other such devices can be used within the system of the invention.

Fuel injectors 22 are arranged to inject fuel into each cylinder of the internal combustion engine 10, and are controlled by the electronic control unit 40 as will be described hereafter. In addition, the intake manifold 12 includes an intake manifold pressure sensor 24 and lead also connected to the control unit 40. A water jacket temperature sensor 26 is also provided to detect the water temperature in the engine 10.

Figure 3:
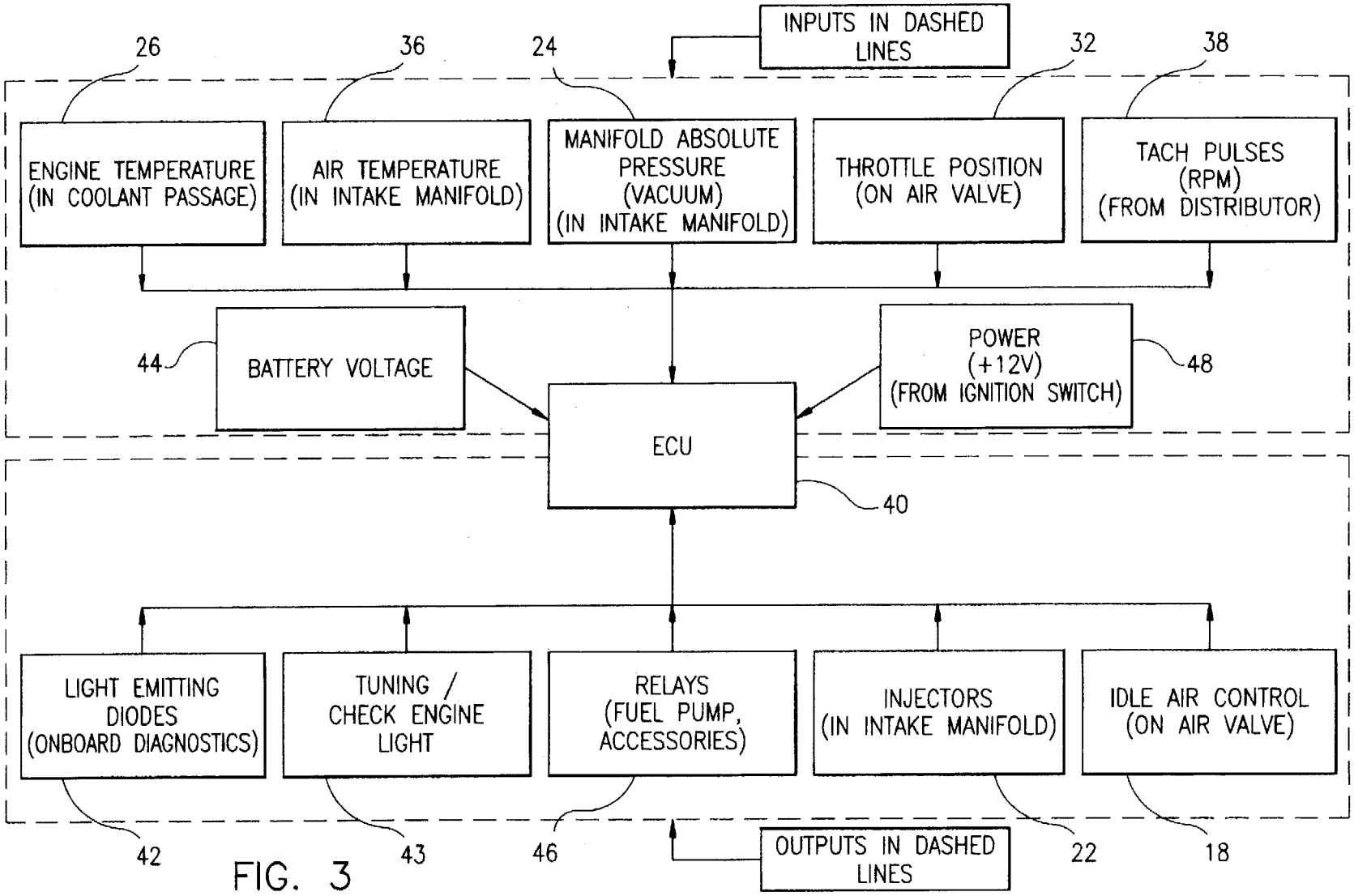
FIG. 3 is a block diagram of the electronic control unit showing the inputs and outputs.

As further shown in FIG. 3 in block diagram form, the electronic control unit 40, i.e., ECU 40, receives inputs from water jacket temperature sensor 26, intake manifold pressure sensor 24, i.e., MAP, air valve position sensor or throttle position sensor 32 ("air valve position sensor" and "throttle position sensor" are terms used interchangeably and mean the same thing), i.e., TPS, intake air temperature sensor 36, and engine speed sensor 38, for example, on the distributor of the engine, which provides a value indicative of revolutions per minute, i.e., RPM, as tachometer pulses.

In addition to the above-discussed sensors, additional input to the ECU 40 is provided by the battery of the engine through a battery voltage level sensor 44. A key sensor 48 from the ignition switch of the engine 10 serves to activate the entire unit when the ignition for the internal combustion engine 10 is turned on.

Output from the electronic control unit 40 serves primarily to control the fuel injectors 22 and the amount of time each injector is opened to inject fuel into a respective cylinder, and controls when the injectors are opened. In addition, the electronic control unit 40 controls the idle air control valve 18, particularly at the time the motor 10 is started and when the throttle blades are closed to control idle speed for load variation.

Figure 4:
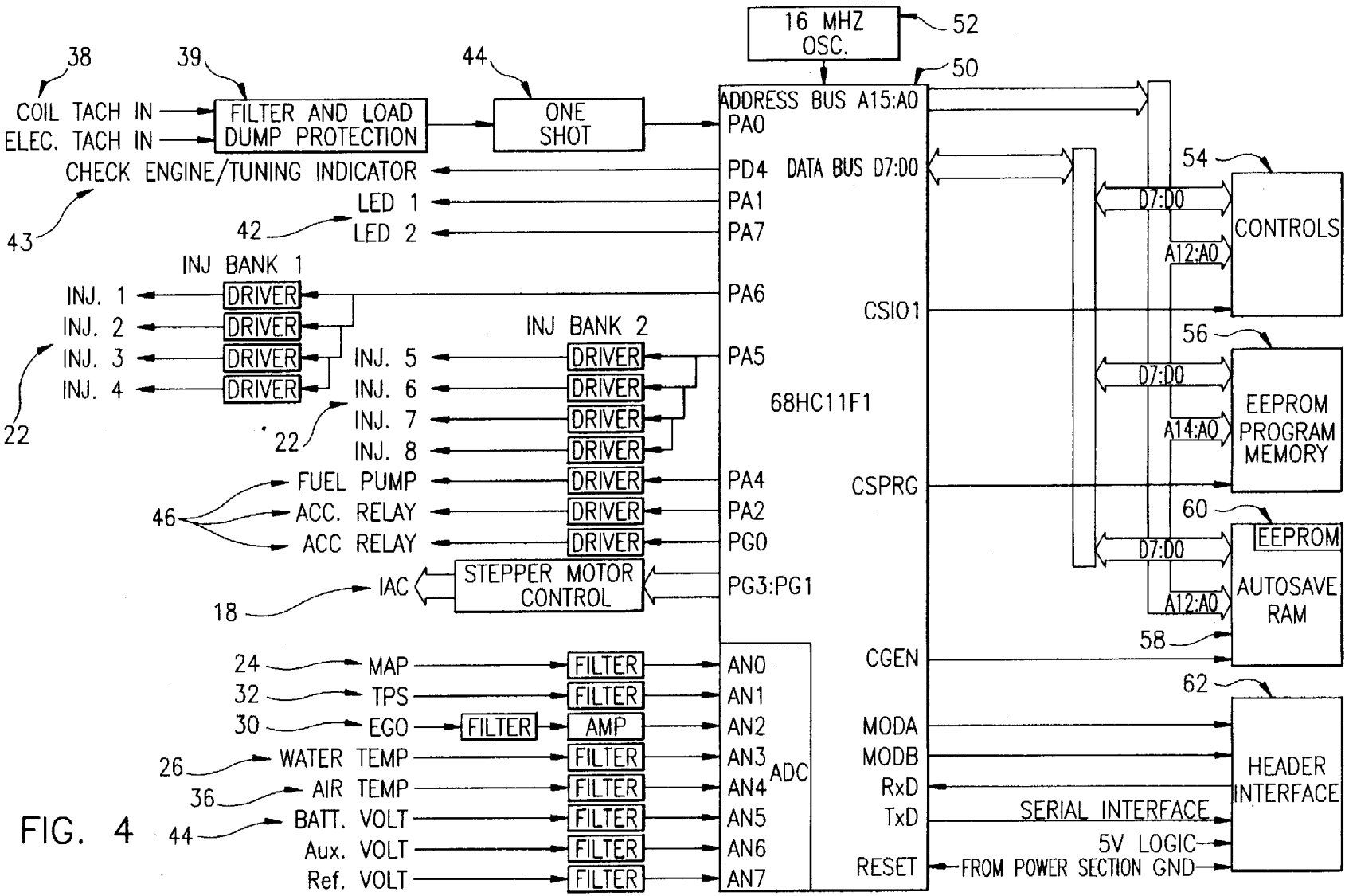
FIG. 4 is a block diagram, in greater detail than that of FIG. 2, illustrating the specific components of the electronic control unit and the various inputs and outputs to different parts of an internal combustion engine upon which the control unit is implemented.

FIG. 4 illustrates in block diagram the electronic control unit 40 in accordance with the invention showing the various components thereof and their connection to various parts of the engine 10. The electronic control unit 40 includes a central processing unit, i.e., CPU 50, of conventional construction such as, for example, a Motorola MC68HC11F1 processor, which is an off-the-shelf central processing unit and which is generally commercially available. The CPU 50 is timed by, typically, a 16 megahertz oscillator 52. It is noted that other central processing units and controllers adaptable to the practice of the invention can be readily substituted as will be readily apparent to those of ordinary skill in the art.

A control module 54 serves to set the various settings of the control unit 40 and consists, for example, of DIP switches, hex rotary switches (HRS), or equivalents, which serve to preset the electronic control unit 40, for example, for engine idle speed, number of cylinders of the engine, etc. Program memory 56, typically EEPROM memory of 32 kilobytes by 8 bits, serves to store the program for conducting the method in accordance with the invention and for controlling the operation of the engine 10. Both the control module 54 and the EEPROM 56 are connected in a conventional manner by address and data buses to the central processing unit 50. Conventional auto-save random access memory 58, i.e., RAM, for example, an off-the-shelf Simtec memory, is provided which includes a separate EEPROM section 60 for permanently storing data when power is shut off, and provides data to run the program in accordance with the invention in a conventional manner, by storing the system fuel map, status, and other like information, and serves to facilitate reprogramming in a self-programming mode, of the electronic control unit 40, as will become more readily apparent hereafter. The reprogrammed changes occurring during each reprogramming operation are stored in the separate EEPROM section 60 of the auto-save RAM 58 when the electronic control unit 40 is turned off.

A header interface 62, of conventional construction, serves to connect the central processing unit 50 to an external input, for example, personal computer or like device, which can be used to initially load program memory at the factory, update and/or change the system program in memory 56, or for factory testing of the system. The inputs and outputs to the various other systems of the engine 10 are shown on the left side of FIG. 3, which clarifies the previously shown engine speed sensor 38 input which is passed through an off-the-shelf filter and transient protection circuit 39 and through a pulse shaping circuit 41, of conventional construction, for input into the central processing unit 50.

Figure 5:
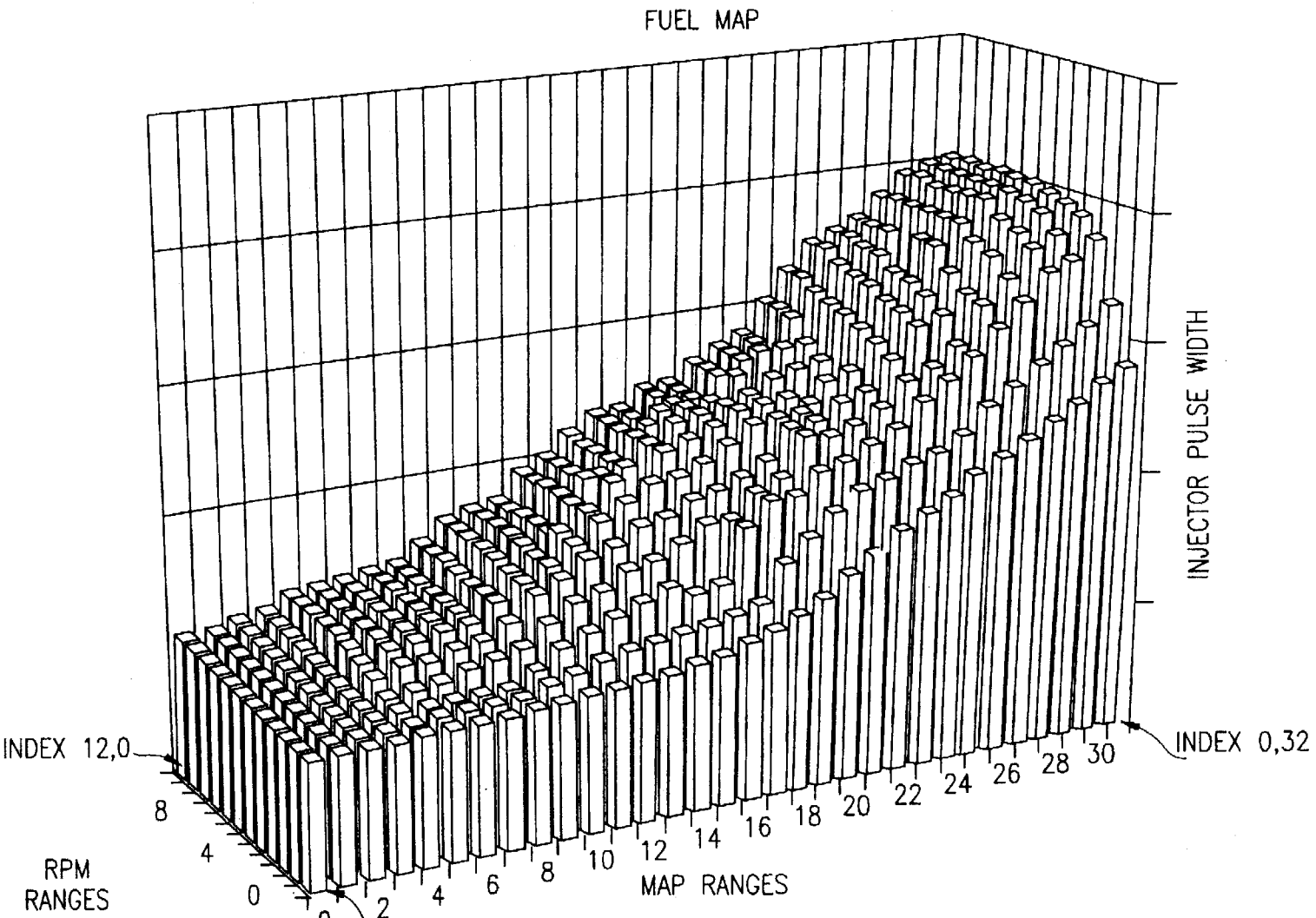
FIG. 5 is a graph illustrating a typical fuel map profile for pulse width of operation for the fuel injectors, as matched to revolutions per minute and intake manifold pressure, of an engine running on which the invention is implemented.

FIG. 5 further illustrates the relationship between the primary operating parameters, which are typically RPM and MAP, and how the pulse width for each pair of parameters is set throughout the entire engine operating profile. As discussed hereafter with reference to FIG. 14, each pair of RPM range and MAP range value for a specific pulse width constitutes an index. As can be appreciated, for any pulse width determination, after running the program of the invention when the engine is running, preset standard pulse widths are replaced with optimized pulse width for particular RPM and MAP pair, i.e., index, as determined with the subroutine of FIG. 14, discussed hereafter.

Figure 6:
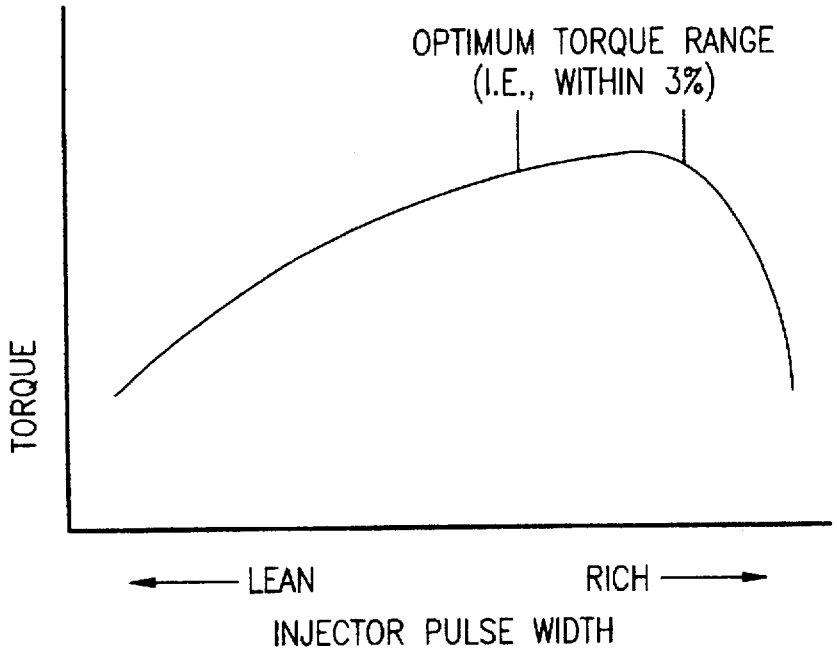
FIG. 6 is a graph more clearly illustrating the relationship between torque and an engine operating between rich and lean conditions to better illustrate how the adjustment in pulse width in accordance with the system and method of the invention is implemented.
Figure 7:
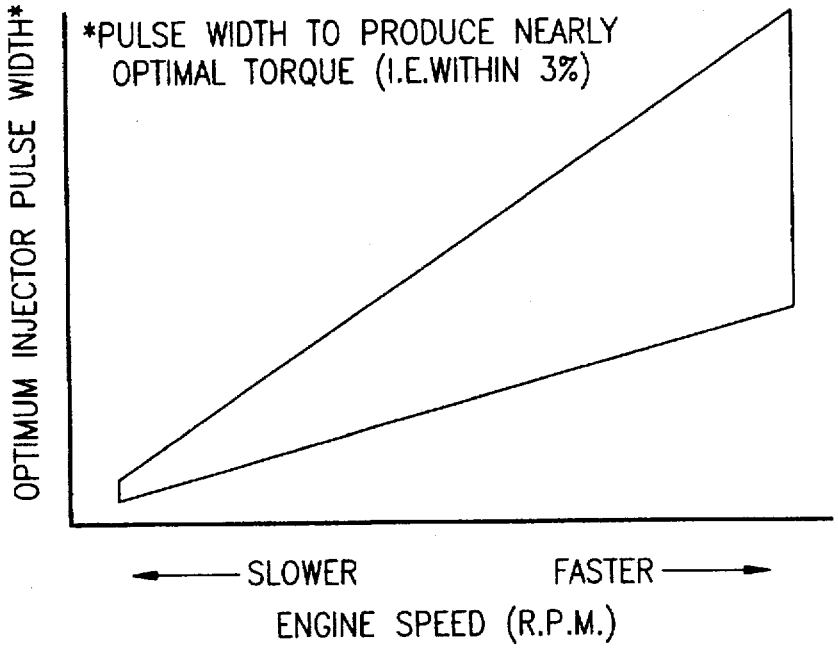
FIG. 7 is a graph illustrating in greater detail the tolerances available with respect to pulse width of operation for the fuel injector as a function of revolutions per minute of operation on an engine upon which the invention is implemented.

To further illustrate how the program of the invention operates in its various aspects, reference is made to FIGS. 6 and 7. In one alternative, once the engine is operating at a pulse width range for a particular detected RPM and MAP, then as shown in FIG. 6, the engine will show a particular torque versus pulse width operation curve for that particular RPM and MAP pair, i.e., index.

There is a direct relationship between torque and acceleration for a particular motor. More specifically, the greater the ability of the motor to accelerate, the higher the torque value. As shown in FIG. 6, as pulse width is varied from peak torque, acceleration ability of the motor will decrease, i.e., decrease in RPM for a set amount of time. In accordance with this operation, engine speed will increase, or MAP will decrease, as peak torque is approached, and both will reverse rapidly as the peak torque has been passed. This effect is particularly pronounced when adjusting in the rich to lean direction, i.e., decreasing the pulse width.

In one aspect of the invention, the point's initial tuning will be done by incrementing the fuel pulse width numbers of, typically, either 3% or 6% toward the rich side of operation of the engine. The change in torque as reflected by change in engine speed is detected and if no improvement in torque is noted, or a decrease in torque is noted, then the direction of adjustment is reversed toward the lean side. Since the operation on the lean side is likely to drop much more quickly than when adjusted towards the rich side, upon an initial drop in performance after changes in pulse width toward the lean side, the changes of pulse width toward the lean side are then reversed one increment, and it has been determined empirically, in accordance with the method of the invention, that the operation of the engine will then be at or near optimum performance. By "optimum" is meant the operating condition of the engine at which the most torque is produced for given operational parameters, e.g., in this particular case, MAP and RPM pair, as adjusted for effects of engine temperature, air temperature, etc. As may be appreciated, alternative implementations may involve initial adjustment toward the lean side, or different percentage size adjustments used to arrive at peak torque. It is noted that under certain engine operating conditions, e.g., above certain RPM, it is desirable to operate the engine on the rich side of peak torque an amount effective to prevent excessive RPM. FIG. 7 illustrates that the higher the RPM of the engine, the greater the range of pulse widths, i.e., air/fuel ratio, at which the engine will operate at or near optimum performance. Therefore, bigger pulse adjustments can be used in tuning at higher RPMs than those that can be used in tuning at lower RPMs.

Figure 8:
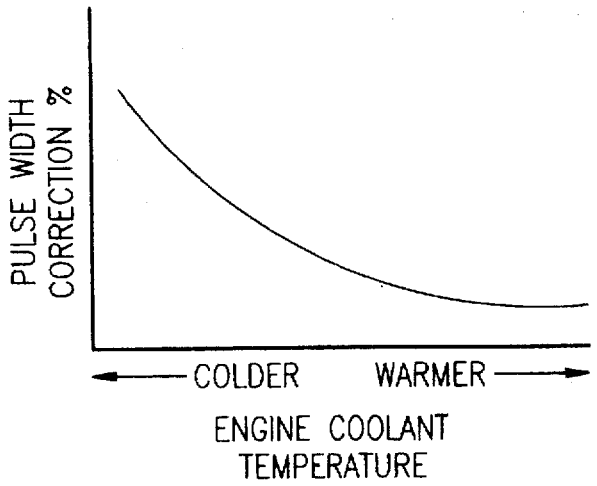
FIGS. 8–10 illustrate respectively the effects of water temperature, air temperature, and battery voltage on the pulse width of the fuel injectors on which the system of the invention is implemented.
Figure 9:
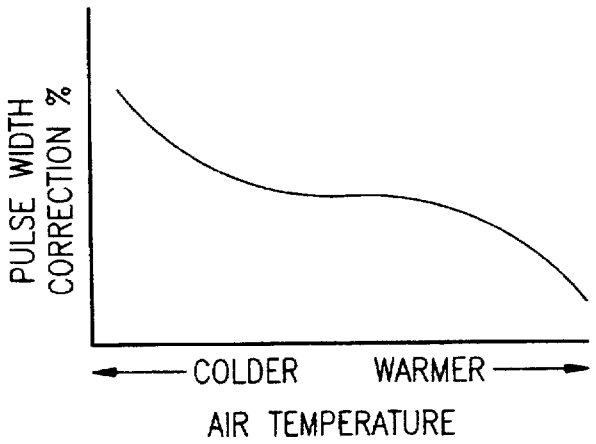
Figure 10:
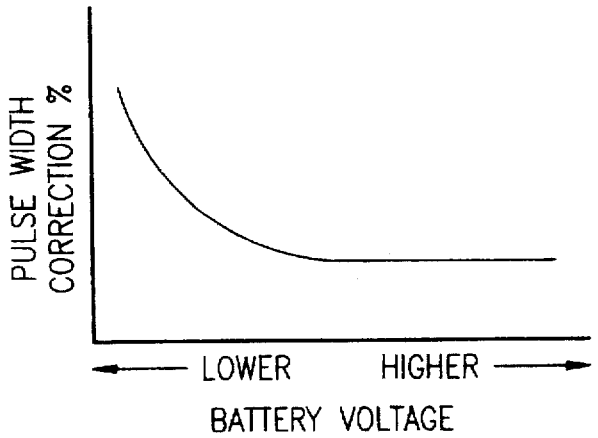

Other parameters which are employed in making corrections to pulse width due to environmental conditions, are more clearly illustrated with reference to FIGS. 8, 9, and 10, which are indicative respectively of the effect of water temperature, air temperature, and battery voltage on pulse width correction. Depending upon the location relative to water temperature, air temperature, or battery voltage, the pulse width is corrected either upward or downward by a predetermined percentage after the pulse width for a particular RPM and MAP has been obtained from the operational fuel map.

Figure 11:
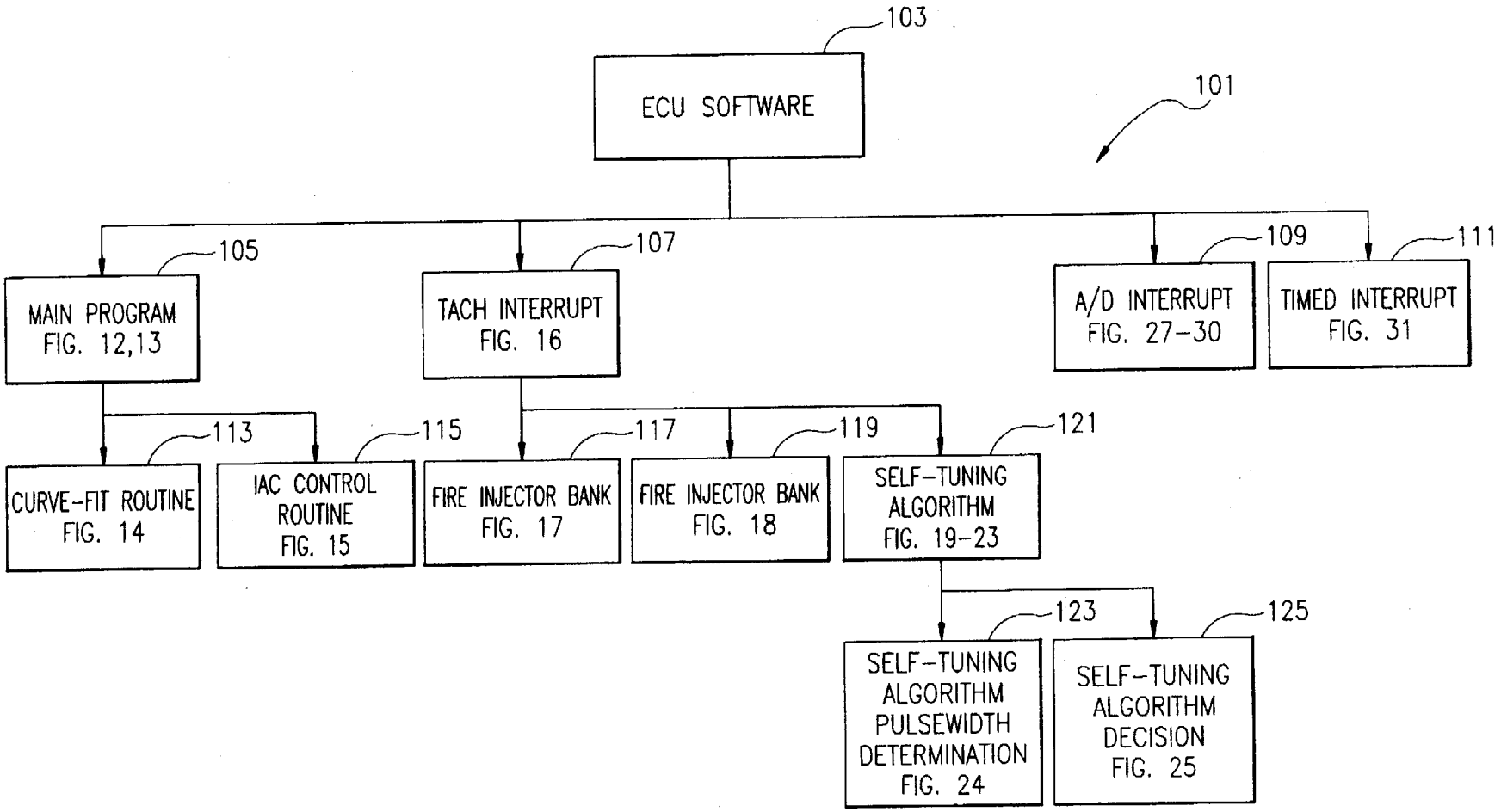
FIG. 11 is a block diagram illustrating the interrelationship between the various subroutines for operation of the system and method in accordance with the invention.

FIG. 11 illustrates in general block diagram form the system software 101 of the invention. In a hierarchy, the electronic control unit software 103 includes as subcomponents thereof a main program 105, a tachometer interrupt routine 107, an A/D interrupt routine 109 and a timed interrupt routine 111. The main program 105 is made up of multiple components. Of particular importance in the main program 105 are: 1) the curve fit routine 113, and 2) the idle speed control routine 115, i.e., IAC routine. The tachometer interrupt routine 107 is also part of the ECU software 103, and includes subroutines 117 and 119 which respectively control the opening and closing of the first and second banks of injectors. A self-tuning routine 121 is also part of the tachometer interrupt routine 107 and includes a component 123 for determining a test pulse width size and a component 125 for determining whether self-tuning was effective to improve engine performance, and will be continued. By "test pulse" is meant a pulse width which is tried for the purpose of determining if engine performance is improved, and provides the basis for modifying the fuel table until a pulse is obtained for achieving optimum engine performance for particular engine operation parameters. The test pulse width is initially determined by the standard fuel map pulse width for current operating parameters, as modified in accordance with the status map for the current operating parameters, as will be discussed hereafter. Also included in part of the electronic control unit software 103 are an analog-to-digital (A/D) interrupt subroutine 109 and a timed interrupt subroutine 111. All of these components of the system software 101 are described in greater detail hereafter.

Turning now to FIG. 12, the main program 105 for running the electronic control unit 103 of the system 101 is illustrated. The main program 105 consists of a first step 201 which is the start of the main program 105. Upon starting the main program at step 201, at a step 203, the microprocessor and system configuration is set, including memory addresses, communication speeds, and I/O port behavior. This is a conventional step with all microprocessor controlled systems and is what is typically known as ordinary housekeeping routines which must be performed in order to permit the central processing unit, i.e., CPU, to run. This step is common to all microprocessor-based systems, and is well known to those of ordinary skill in the art.

At step 205, the fuel pump of the engine is turned on to prime the fuel system thereof. At step 207, program variables are initialized and user-adjustable switches, e.g., DIP switches, 16 position hex rotary switches (HRS), or equivalent switches, in the controls 54, for the system are read. The first several injector pulses, i.e., start-up pulses, are set (initialized ) to be double their normal size to prime the engine for easier starting. All of the previous steps are conventional and the steps necessary to implement them would be readily apparent to those of ordinary skill in the art from this description. At step 209, if the proper sequence is set on the switches found in the controls 54, then error codes, if any, are blinked out on two on-board LEDs 42. At step 211, if the proper sequence is set on the switches in controls 54, the error codes are then cleared.

At step 213, random access memory, i.e., RAM, is checked to identify a string of information therein for errors. If errors are detected at step 213, the initial fuel map and status map (both described hereafter) from program read-only memory 56 are reloaded. In this regard, at this step the auto-store random access memory 60 should never lose data once it is loaded unless its life expectancy has been reached. If this has occurred, errors will become more and more frequent and the electronic control unit 40 should be replaced on the engine. Thereafter, at step 215, the switches in the controls 54 are checked for a specified or unique reset sequence. If the switches have been set in accordance with the specified or unique reset sequence, then the initial fuel map is reloaded along with the status map from program read-only memory 56. More specifically, at this step, for some reason the operator may wish to reset the electronic control unit 40. This may be necessary if the system is transferred to another engine or if a major modification is made to the existing engine.

Thereafter, the acceleration enrichment buffer is cleared at step 317. This buffer is used to store pulse-width enrichment values based upon movement of the throttle pedal. This mimics the accelerator pump on a carburetor and will be described in greater detail in the A/D interrupt subroutine described with reference to FIGS. 27–30 hereafter.

At step 221, once the initial configuration steps are performed in the main program 105, the main loop of the main program 105 is started. It should be appreciated that the electronic control unit 40 remains in this loop until power is turned off.

At step 223, a determination is made as to whether the electronic control unit is tuning. If the answer is "yes," the tuning indicator light is turned on, and if the answer is "no," the tuning indicator light is turned off. The tuning indicator light is a light within the driver's compartment which is used to tell the operator that the electronic control unit is tuning a new point, and as previously described, to blink out errors, i.e., go into a blinking mode if an error occurs at any time during operation. This will allow the driver to seek out untuned operational ranges by changing throttle position to vary RPM and load on the engine so that the electronic control unit 40 can tune as many points as possible.

At step 225, a determination is made as to whether the engine is running, if the answer is "yes," the system checks to make sure the fuel pump is turned on.

Moving to FIG. 13, at step 227, if the electronic control unit 40 has not yet received tachometer pulses, and the throttle is at a position which is more than three quarters open, fuel injection is prevented. This allows the operator to clear out excess fuel if it is believed the engine is flooded. Alternatively, if the throttle is less than three quarters open, as determined at step 229, fuel injection is then enabled. At step 231, if the throttle is more than three quarters open, power to the idle air control motor 18 is turned off to keep the idle air control motor 18 from heating up and to reduce power consumption. This is because the idle air control motor 18 is only used when the throttle is closed or nearly closed, so that anytime the throttle is more than three quarters open, the idle air control motor 18 is turned off since it is no longer necessary for operation. Alternatively, if the throttle is less than three quarters open, the idle air control motor 18 is turned on. If the idle air control motor 18 is turned on, then the idle air control routine is executed at step 233, as described with greater detail with reference to FIG. 15 hereafter.

Figure 31:
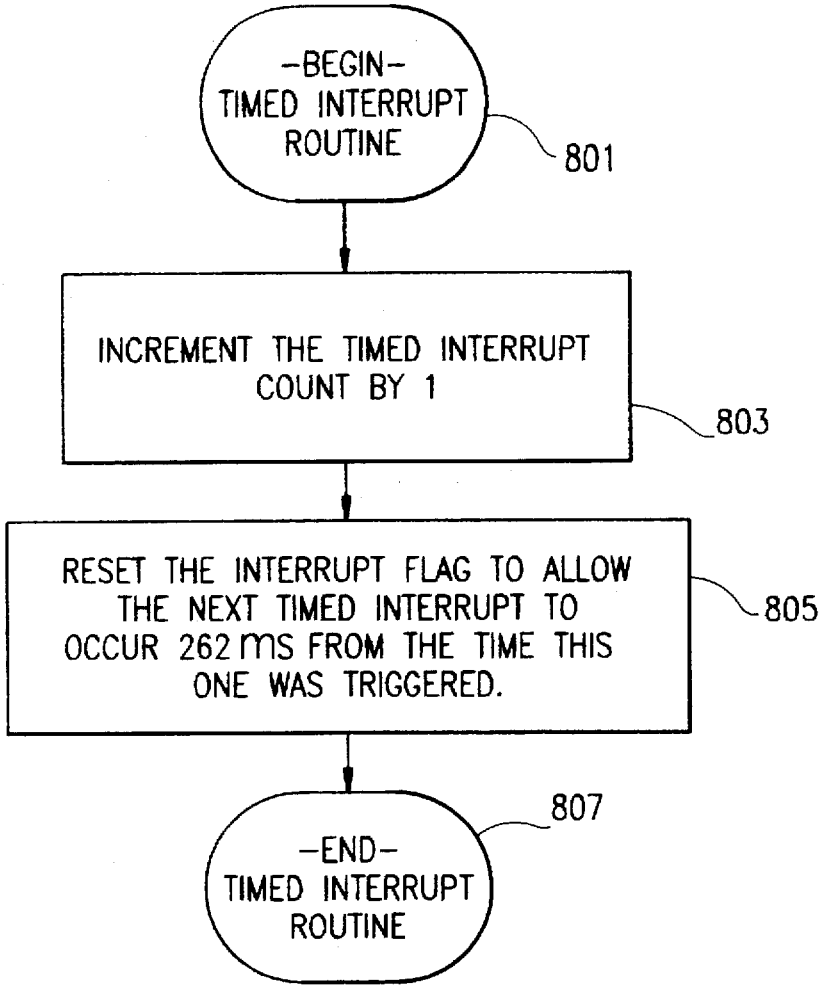
FIG. 31 is a flow chart illustrating the timed interrupt which occurs at predetermined intervals to ensure that counters in the system do not overflow and timing of the operation of the software is maintained accurately.

At step 235, it is determined if the timed interrupt, as described in greater detail with reference to FIG. 31 hereafter, has occurred five or more times since the last engine revolution. If the answer is affirmative, then it is assumed that the engine is no longer running and if the electronic control unit 40 is in the middle of the tuning process, the process will be cancelled. More particularly, the timed interrupt is set to occur about every 0.262 seconds so that five interrupts will take about 1.31 seconds. If the timed interrupt has occurred ten or more times since the last engine revolution, at step 237, the fuel pump is turned off and the number of start-up pulses is reset. At this step, ten interrupts will take approximately 2.62 seconds. When the engine begins to turn over, after engine stalling, start-up pulses are reinitialized, and the first several injector pulses are again set to be double their normal size to prime the engine for easier starting. The tuned interrupt, as described later with reference to FIG. 31, is used because registers in the system are 16 bit registers and will overflow if the time between tachometer pulses is greater than a set amount. This occurs at, for example, low RPMs. On the other hand, if other hardware configurations are used, such as 32 bit registers, the timed interrupt is not necessary, as will be readily apparent to those of ordinary skill in the art.

At step 239, the curve fit routine described hereafter with reference to FIG. 14, is implemented. Providing that if the electronic control unit 40 has just tuned a point, it then adjusts the rest of the untuned points accordingly by using pre-stored fuel maps within the system. These curves are known as "template fuel maps" and consist of a database of pulse width values for injecting fuel corresponding to specific engine operating parameters, and are designed to meet approximately the operational needs of a vast assortment of engines, without being optimized for any particular engine. If desired, step 241 serial communications can be implemented, for in-house testing only, through the header interface 62. More particularly, the electronic control unit 40 has the ability to communicate with factory test computers. This step is used only for product testing and will not be used in the actual running of the system by a typical user.

At step 243, it is determined if the voltage is too low or if there is still some acceleration enrichment and if the answer is "yes," self-tuning is suspended for one second. At step 245, if the electronic control unit 40 is tuning and the throttle position sensor, revolutions per minute or manifold absolute pressure changes significantly, tuning is cancelled and inhibited to cause a delay of one second. At step 247, the electronic control unit 40 remains operating in the loop leading back to step 221 until power is turned off. The instruction sequence of the main program ends at step 249. This is a conventional terminator step well known to those of ordinary skill in the art of programming.

FIG. 14 illustrates the curve fit routine 113 which is implemented at step 239 of the main program 105 as discussed with reference to FIGS. 12 and 13 previously. The curve fit routine 113 is commenced at step 251. At step 253 the self-tuning process is inhibited while curve fitting is performed in accordance with the method of the invention. At step 255 a curve fit loop is commenced for each one of the standard template curves originally stored in program memory 56. In comparing the points previously tuned, enough is added to every point in the template fuel map, i.e., standard fuel map, so that every tuned point in the operational fuel map is equal to or less than the corresponding point of the template fuel map at step 257. At step 259 the total variance for the template fuel map is obtained by taking the sum of the difference between each tuned fuel map point, and the corresponding point in the template fuel map. At step 261, a determination is made whether the modified template fuel map, i.e., temporary fuel map, has less total variance than any temporary fuel map previously determined in this iteration of the curve fit routine 113. If the answer is "yes," this new fuel map is saved as the new best-fit fuel map. At step 263, the curve fit loop is terminated, after having gone through each one of the standard template fuel maps.

At step 265, the subroutine goes through the fuel map determined to have been the best-fit, i.e., the best-fit fuel map, and makes sure that there are no injection times of less than, for example, about 2 milliseconds or greater than about 15 milliseconds. These values are determined in accordance with the particular injectors and speed of operation of the engine and can be varied in accordance with the components on which the invention is implemented. For example, present fuel injectors do not work properly with a duty cycle of less than about 2 milliseconds and the fuel map of the system does not allow numbers greater than 16 milliseconds. In order to keep the injection times in the range noted, the injector size for each engine must be determined based upon its peak horsepower.

At step 267, for the engine speed, i.e., revolutions per minute, range in the fuel map, as illustrated with reference to FIG. 5 set forth previously, if there are two or more tuned points in the range, the values of all the untuned points between them are interpolated to obtain specific values for each untuned point which provides a smooth transition from the lowest to the highest tuned values. If there are one or more tuned points in the range, then all points with a map index less than that of the lowest map index tuned point are checked. If their pulse width value is greater than the pulse width value of the tuned point with the lowest map index, it is then set equal to the pulse width value of the lowest map index tuned point for the particular RPM. For all points in the particular RPM range with higher indices than the highest index tuned point, their pulse width values are decreased by an amount equal to the difference between the actual pulse width value of the highest index tuned point and the corresponding pulse width value in the best-fit fuel map. By index is meant the location of a given pulse width in a particular fuel map. Viewed with reference to FIG. 5, each index is based upon a pair of a particular MAP range value (representative of engine load) and a particular RPM range value to define the pulse width location within the fuel map.

Thereafter, at step 269, all untuned values in the operational fuel map are replaced with the corresponding points in the best-fit fuel map. The changed operational fuel map is saved to EEPROM 60 when power is turned off. At step 271, if a particular point was tuned when the engine temperature was too low, the status map (discussed hereafter) is reset so that it will be retuned. At step 273 tuning is then reenabled and normal pulse width calculations continue. The fuel map or curve fit routine is ended at step 275. In this context, fuel map fit and curve fit refer to the same thing.

Figure 24:
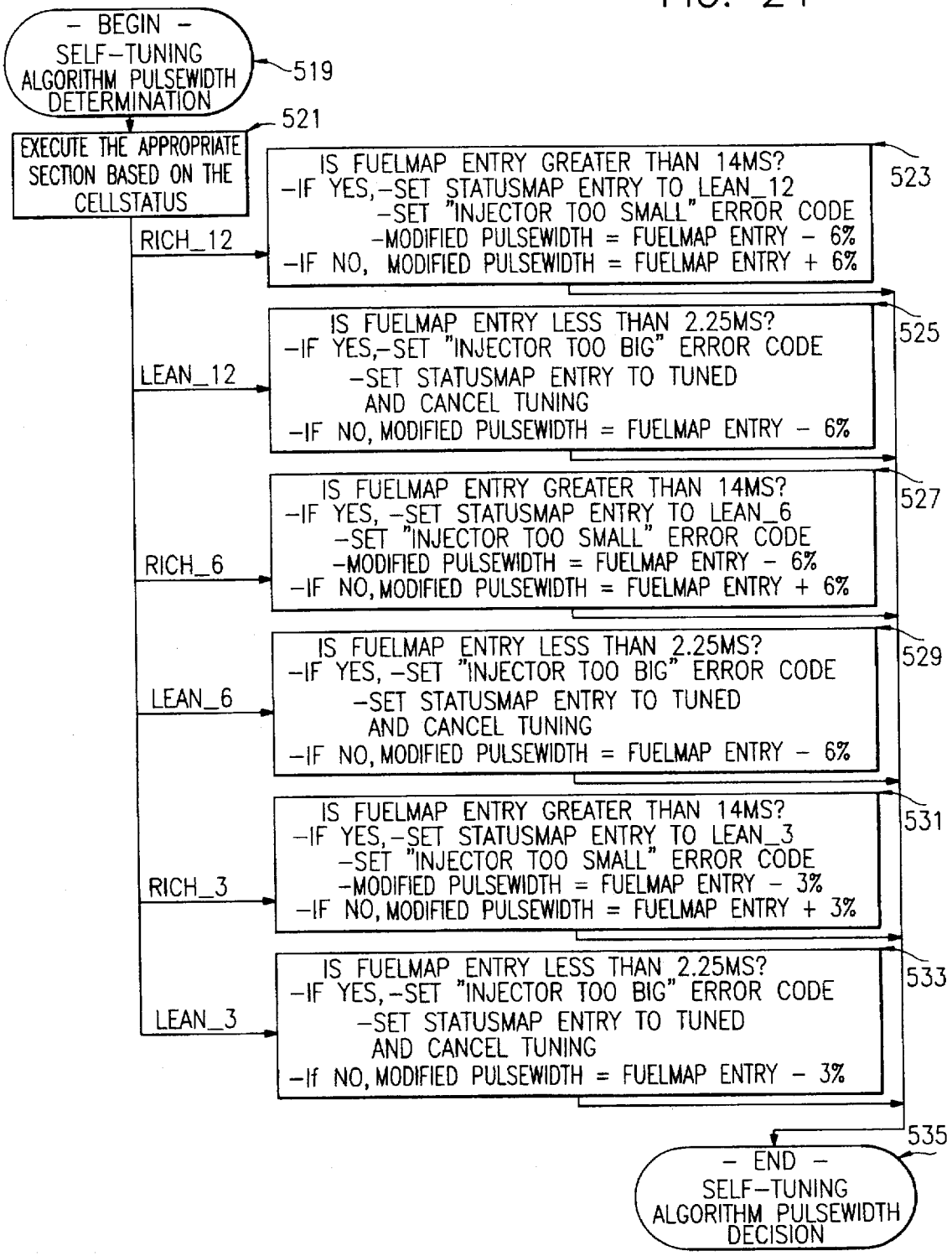
FIG. 24 is a flow chart illustrating how pulse width is selected for a selected manifold pressure and selected revolutions per minute of operation of an engine.
Figure 25:
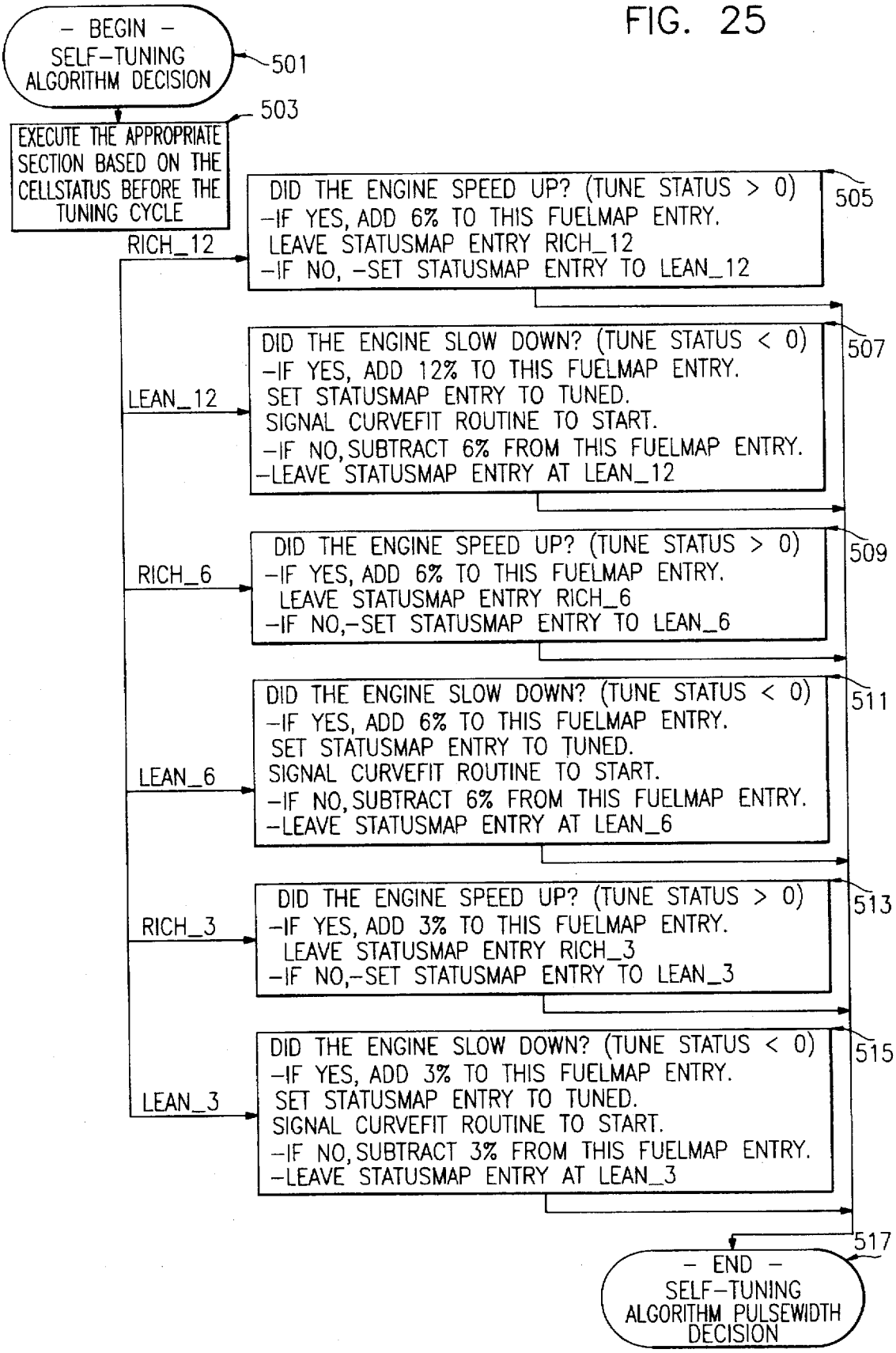
FIG. 25 is a flow chart illustrating how a fuel map is selected after a self-tuning operation in accordance with FIGS. 19–23.
Figure 26:
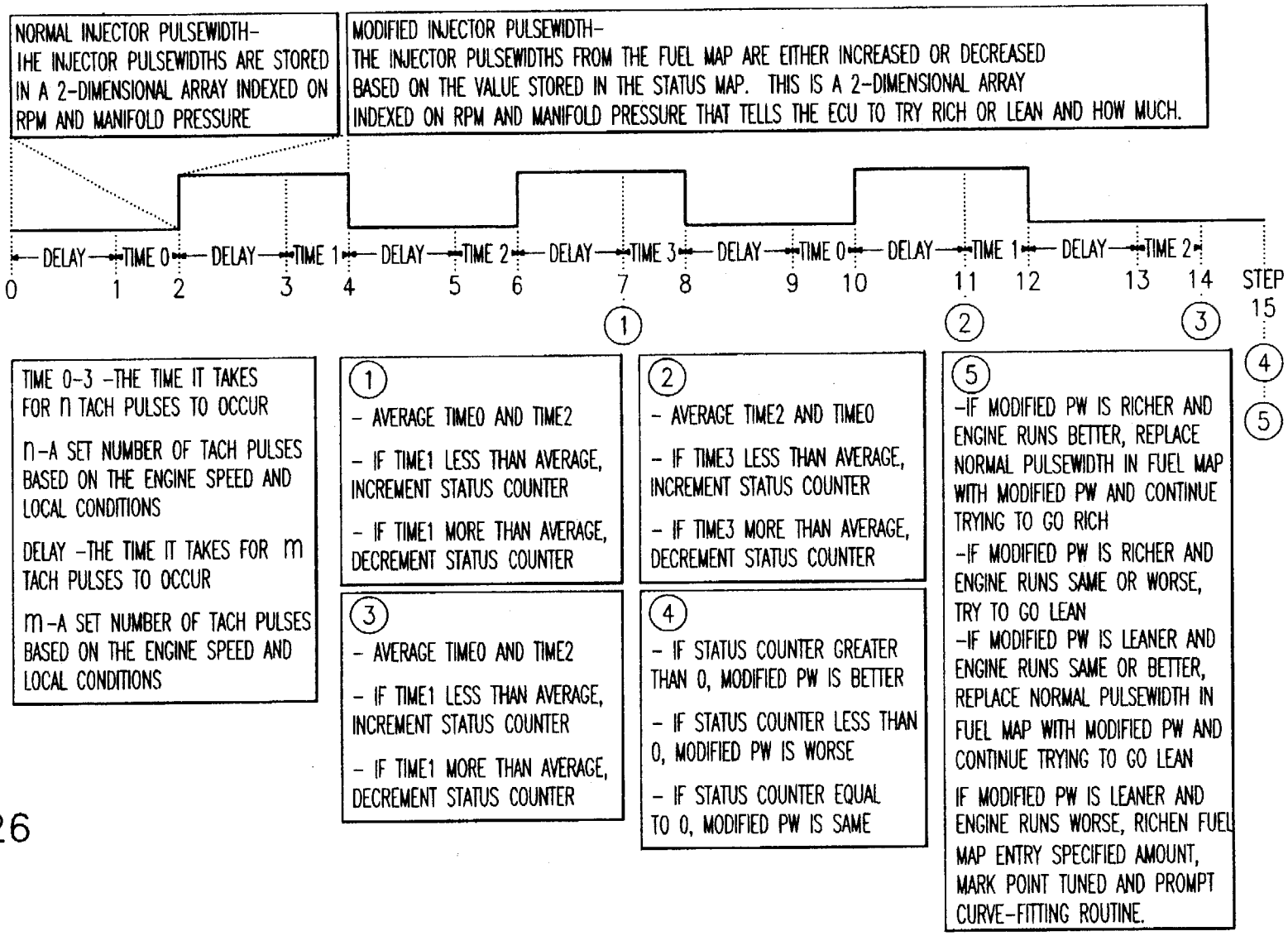
FIG. 26 is a block diagram illustrating the method of fuel injector pulse width adjustment conducted within the system of the invention.
Figure 28:
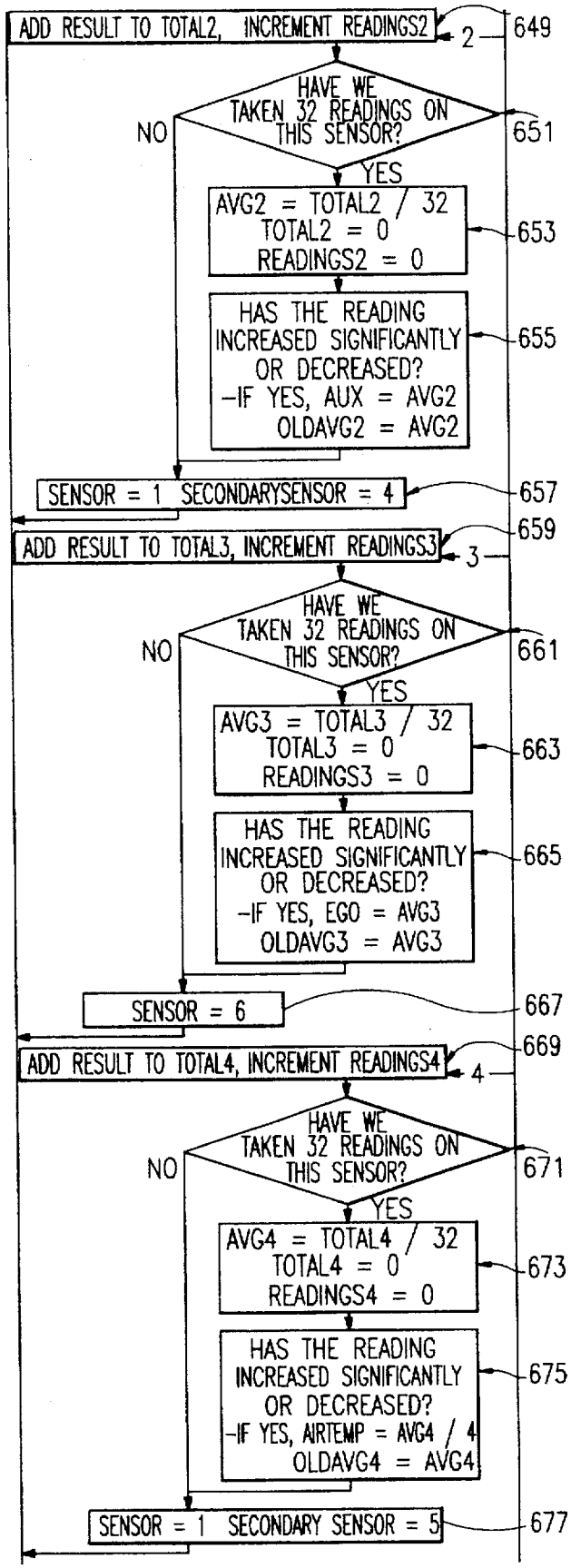
Figure 29:
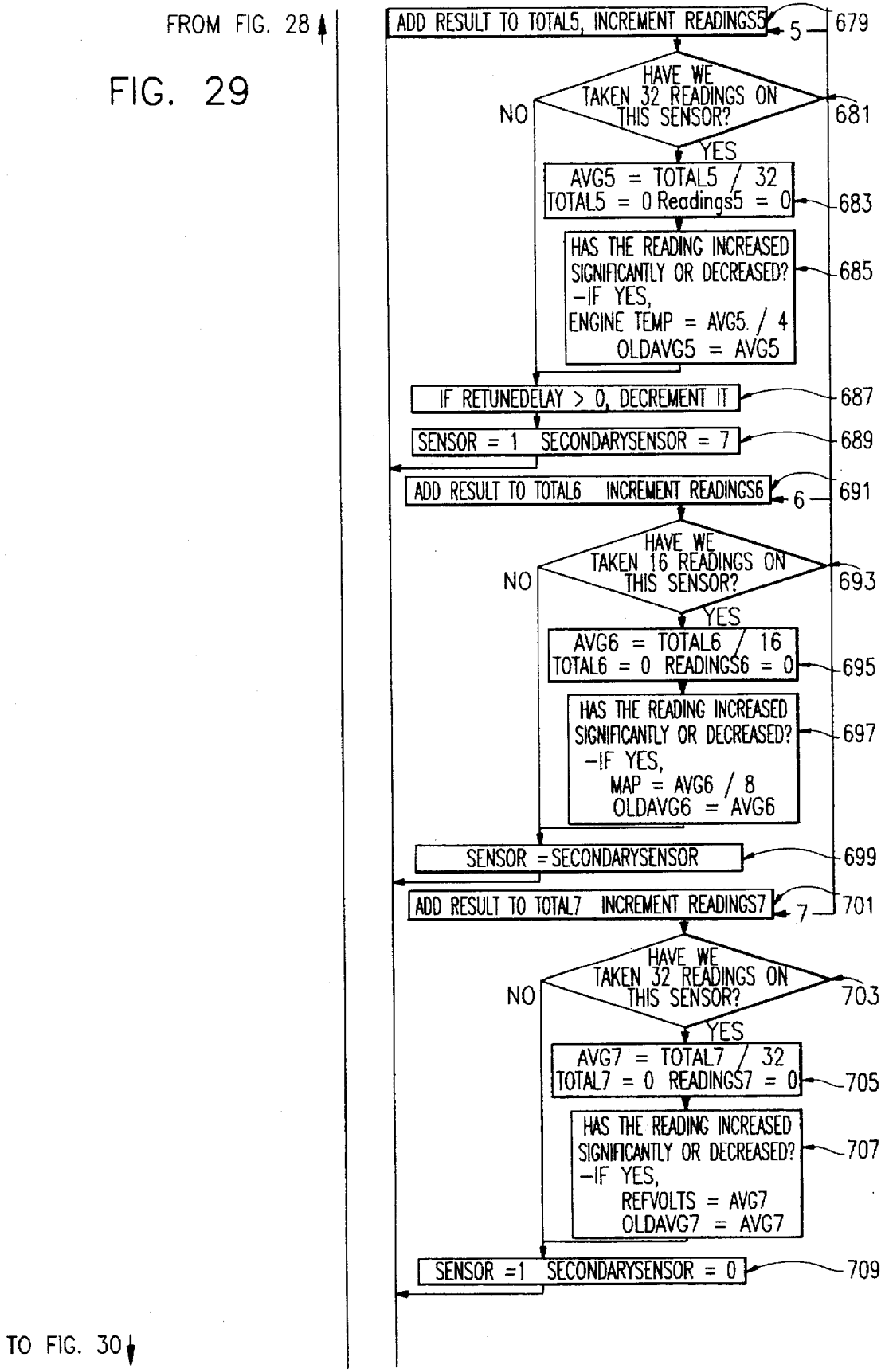
Figure 30:
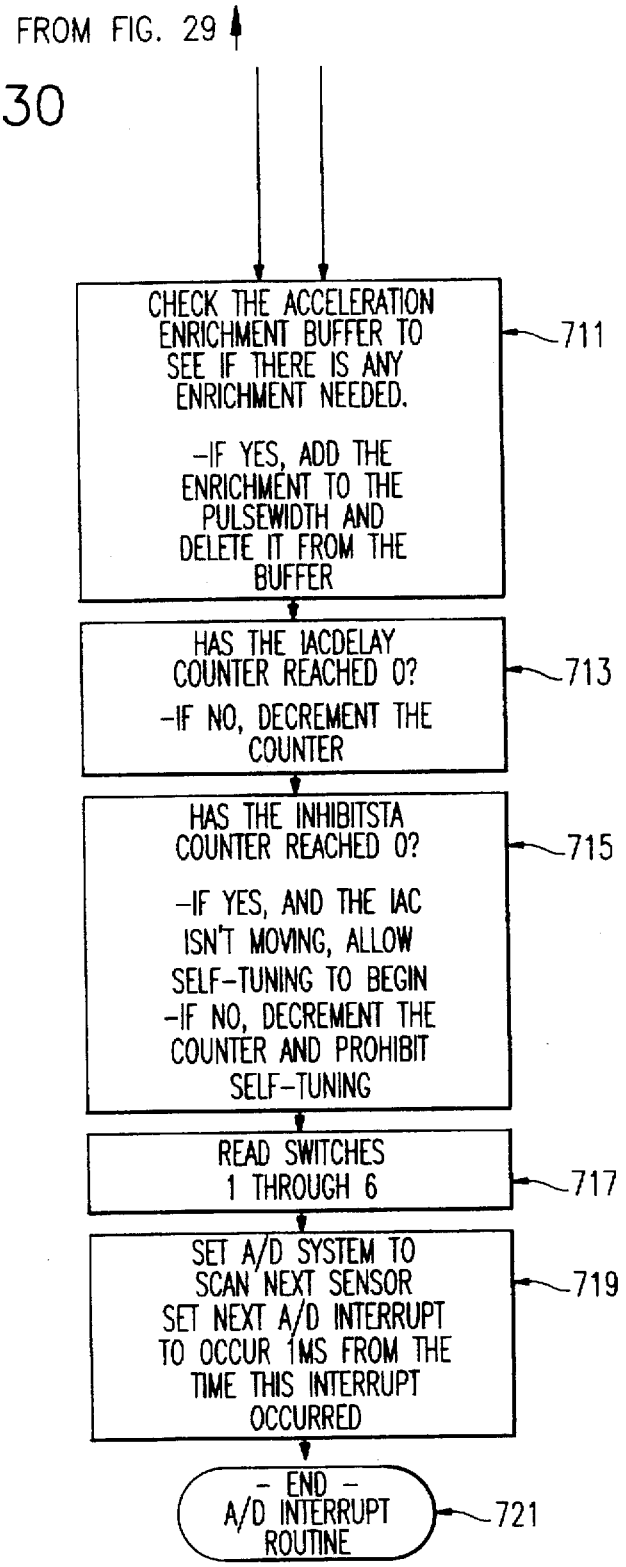

FIG. 26 illustrates in better detail how the tuning algorithm is implemented to optimize fuel injector pulse width for a particular MAP and RPM pair, i.e., index, and is shown implemented by FIGS. 19–25, discussed hereafter. This Figure is believed self-explanatory and the replacement of the pulse width associated with the pair of engine operating parameters, in particular, RPM and manifold pressure (MAP), are employed to update and optimize operation of the engine in a self-programming manner. Thus, it is not necessary to discuss this figure further at this point.

Figure 15:
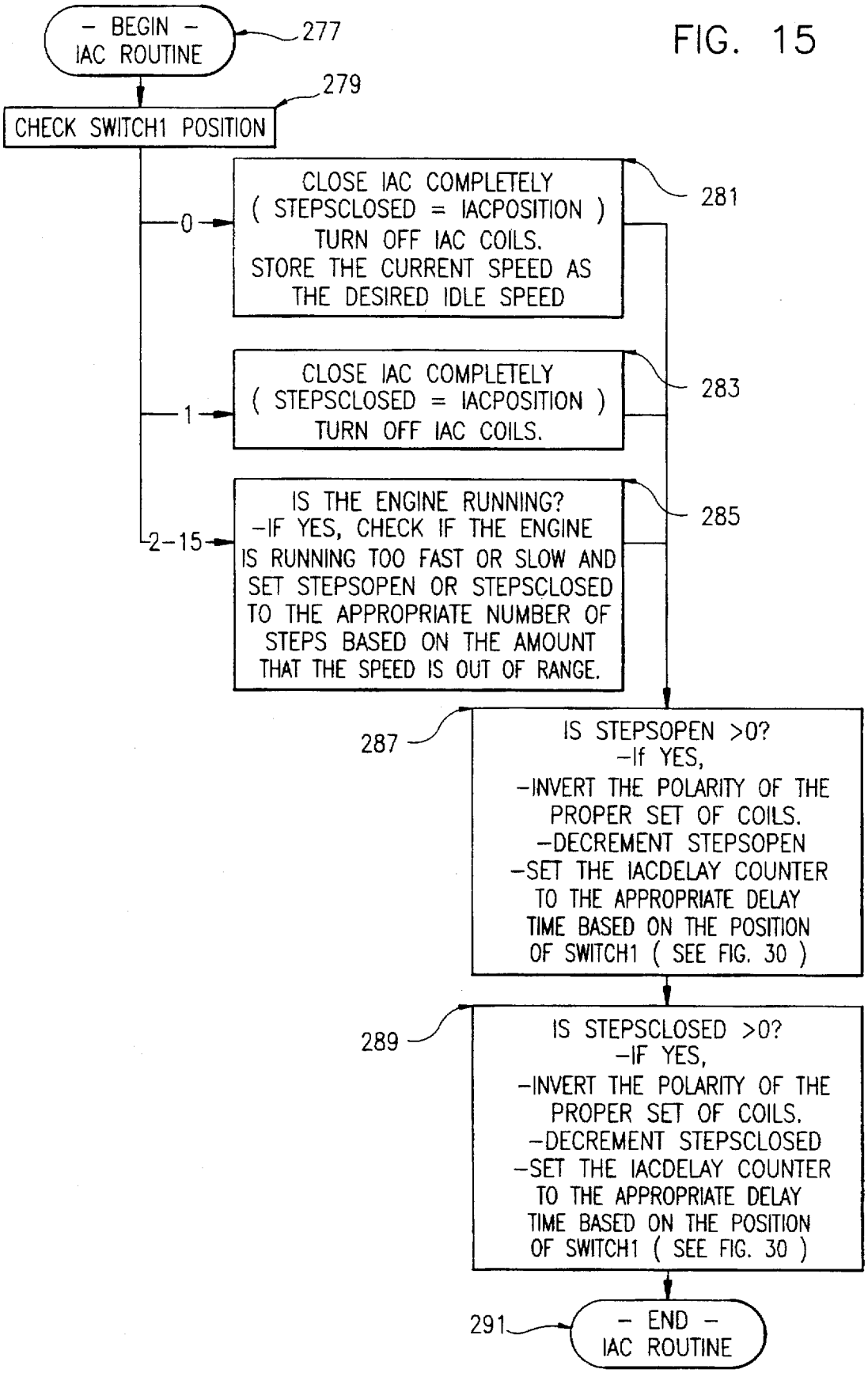
FIG. 15 is a flow chart illustrating the idle air control valve routine, shown in one of the blocks of the main program of FIG. 4.

In FIG. 15, the routine for controlling the idle air control motor 115, i.e., IAC, is illustrated. It is started at a step 277 with first step 279 of checking the idle air control switch (Switch 1) position for the idle air control motor. Switch 1 is one of the user adjustable switches, e.g., 16-position hex rotary switches, described previously. Since it is a 16-position switch, at Switch 1 position 0, the program goes to step 281, at Switch 1 position 1, the program goes to step 283, and at Switch 1 positions 2–15, the program goes to step 285.

At step 281, the idle air control motor 115 is caused to close its associated idle air control valve completely. The idle air control motors coils are shut off to conserve power and reduce heat build up. The current speed of the motor is stored as the desired idle speed and the current throttle position (TPS reading) is stored as "throttle closed" position.

At step 283 the idle air control valve is closed completely and the idle air control coils are shut off. This position is selected by a user if it is desired to deactivate operation of the IAC completely.

At step 285 if the switch position is at one of Switch 0 positions 2–15, an inquiry is made as to whether the engine is running. If the answer is "yes," a check is made to determine if the engine is running too fast or too slow, and the steps "open" or "closed" are set to the appropriate number of steps based upon the amount that the speed is out of range. At Switch 0 position 2, IAC response time is fastest, and at Switch 0 position 15, IAC response time is slowest. The position selected depends upon the response of the particular engine on which the system is implemented to the movement of the IAC.

At steps 287 and 289, if the number of steps open is greater than zero, one set of a plurality of a proper set of coils of the idle air control motor 18, is inverted so as to cause the valve to step toward the open or closed position, and the steps open or closed are decremented. An idle air control delay is then set to the appropriate delay time based upon the position of Switch 1, as discussed hereafter with reference to FIG. 30. In this regard, it is noted that the idle air control delay is used to allow the idle air control motor time to move after a step is taken and to give the engine time to respond. The idle air control delay is decremented once every one millisecond in the A/D interrupt routine discussed hereafter with reference to FIGS. 27–30.

With respect to idle air control valve movement, there are two sets of coils in the idle air control motor 18 (typically a stepper motor). The polarity of the coils is kept track of in order to know the position of the armature thereof. By inverting the polarity of the appropriate set of coils, the armature is caused to move one step to change the position of the idle air control valve in the appropriate direction. The idle air control routine is ended at step 291.

Figure 16:
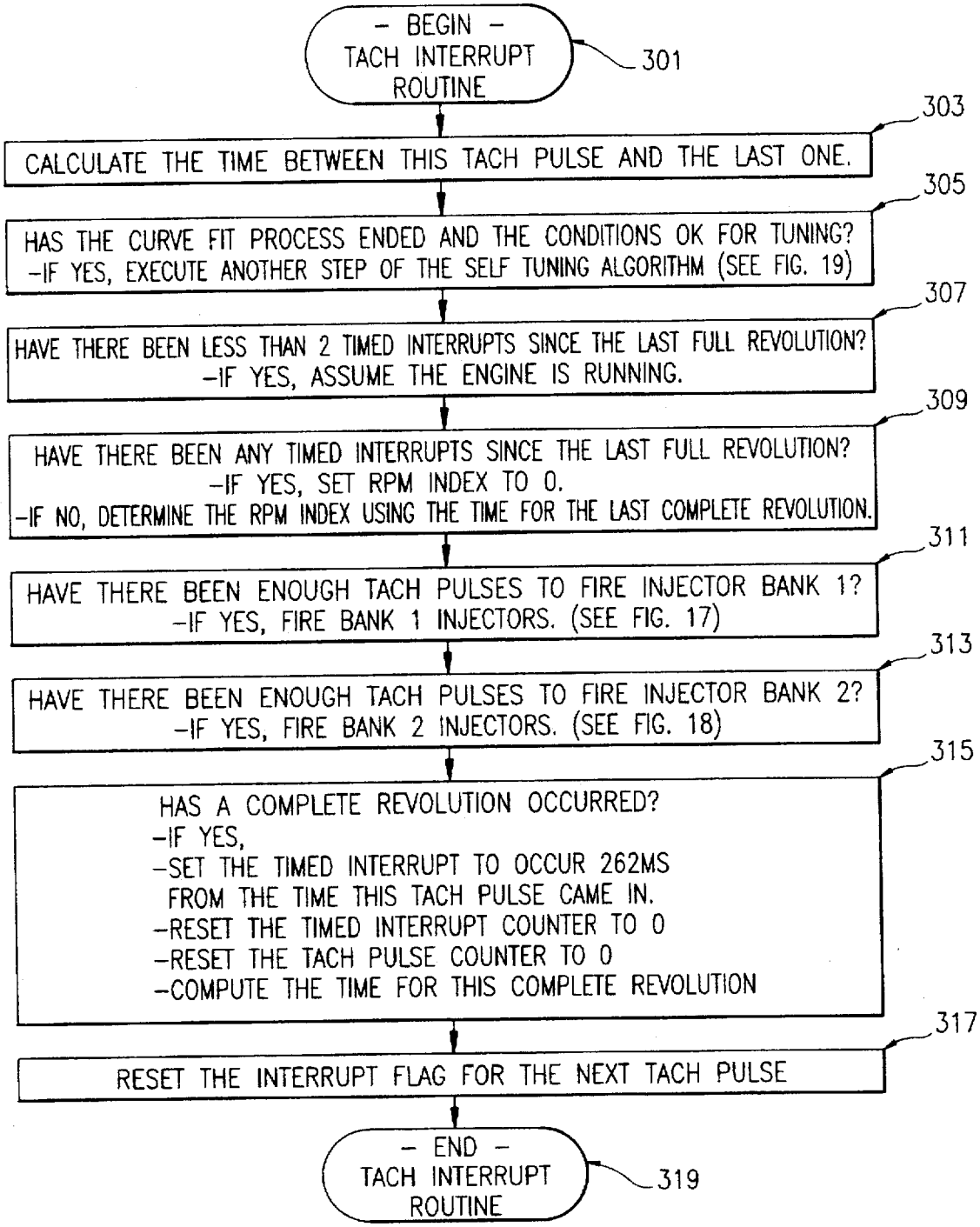
FIG. 16 is a flow chart illustrating the tachometer interrupt routine for synchronizing fuel injector pulses with tachometer pulses, and for allowing the electronic control unit to compute engine speed for adjustment of the fuel pulses.

FIG. 16 illustrates in detail the tachometer interrupt routine 107, which begins at a step 301. The time between a particular tachometer pulse and the previous one is calculated at step 303. This time is used to compute the revolutions per minute (RPMs) of operation of the engine. At step 305, it is determined if the curve fit or fuel map fit process described previously has ended and if the conditions are satisfactory for tuning. If it is determined that the curve fit process has ended and conditions are satisfactory for tuning, another step of the self-tuning algorithm described hereafter with reference to FIGS. 19–23 is executed. At step 307, it is determined if there has been less than two timed interrupts since the last full revolution. If the answer is "yes," it is assumed that the engine is running. At step 309, it is determined if there have been any timed interrupts since the last full revolution, as described in detail with reference to FIG. 31 hereafter. If the answer is "yes," the RPM index is set to zero. If the answer is "no," the RPM index is determined using the time for the last complete revolution. At step 311, it is determined if there have been enough tachometer pulses to open (the terms "open" and "fire" are used interchangeably) the first injector bank (of two injector banks). For example, in the case of V-8 engine, an injector bank is made up of a set of half of the nozzles for the engine, for example, one bank is made up of the nozzles on the left side of the engine, and another bank is made up of the nozzles on the right side of the engine. If the answer is "yes," then the first bank of injectors is opened, as described hereafter with reference to FIG. 17. Step 313 employs the same methodology of step 311, in this case, to control operation of the second bank of injectors.

At step 315, it is determined if a complete revolution of the engine has occurred and if so, the timed interrupt is set to occur, for example, about 262 milliseconds (this value is dependent upon hardware selected) from the time the particular tachometer pulse came in. The timed interrupt count is reset to zero and the tachometer pulse count is reset to zero. The time for the most recent complete revolution is then computed.

With respect to steps 307–315, as described above, the timed interrupt occurs about every 262 milliseconds and is reset after every complete revolution. The purpose of this interrupt routine is to compensate for the fact that at low engine speeds, the amount of time between tachometer pulses will overflow the counters of the particular hardware employed and give wildly inaccurate readings. By counting the number of timed interrupts that occur between revolutions, the accuracy of the value in the counter can be checked.

At step 317, the interrupt flag which was set by the previous tachometer pulse which caused this routine to occur is reset to be triggered by the next incoming tachometer pulse and the tachometer interrupt routine is then ended at step 319.

FIG. 17 shows the subroutine 117 for opening or firing nozzles in the first injector bank. This subroutine 117 commences at step 321. At step 323, it is determined if the electronic control unit 40 is tuning. If the answer is "no," the fuel map index is calculated from the manifold vacuum pressure and the RPM index. The base pulse width in the fuel map is found, and the injector pulse width is computed using the base pulse width and correction factors for engine temperature, air temperature, system voltage, and throttle movement. If the particular pulse is one of the first few pulses, i.e., start-up pulses, as described previously with reference to FIGS. 12 and 13, the pulse width is doubled. In this step 323, engine temperature is used to determine cold-start and warm-up enrichment. Air temperature is used to compensate for air density, system voltage is used to compensate for slower injector opening times under low-voltage conditions, and throttle movement (TPS) is used to determine extra enrichment required under transient conditions caused by any quick opening of the air valve throttle blades.

At step 325, the computed and corrected pulse width is added to the value of the system clock and loaded into the output compare register controlling the first bank of injectors. Output compare registers are provided and are standard features of the type of microcontroller chip with which the invention is implemented, as discussed previously, which causes the injector nozzles to turn off when the system timer reaches the specified value that was previously loaded in the output compare register. At step 327, the first bank of injector nozzles is started and the subroutine is terminated at step 329, which results in the first injector bank being fired. FIG. 18 illustrates a similar subroutine as that of FIG. 17, with respect to the second injector bank through steps 331–339, and need not be described in greater detail herein since it is self-evident from a reading thereof.

Figure 19:
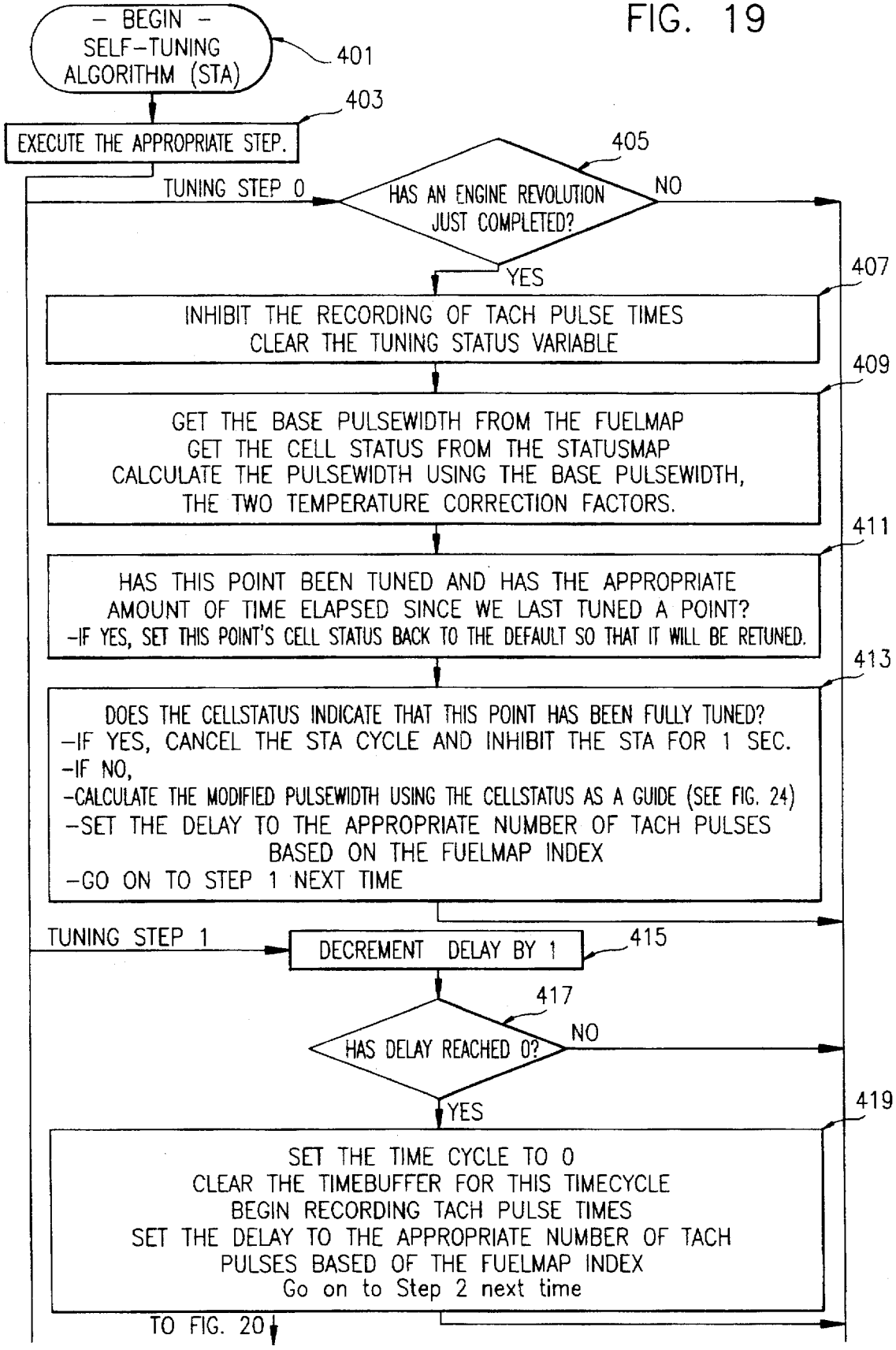

FIG. 19 illustrates a self-tuning algorithm 121 which is part of the tachometer interrupt subroutine 107. The self-tuning algorithm 121 is commenced at step 401, which leads into a step 403 at which the appropriate step of the self-tuning algorithm 121 is selected as will be readily apparent to those of ordinary skill in the art from the following description, made with reference to the steps 0–15 set forth throughout FIGS. 19–23. A predetermined number of tachometer pulses are used to separate each step. thus, step 0 corresponds to the first tachometer pulse of a particular tuning cycle.

At this time, a tuning status variable is set to zero. This variable is used to keep track of the results of each iteration of tuning conducted with the tuning algorithm 121. Every time a modified pulse width is used, and results in an increase in performance, this variable (the "tuning status variable") is incremented by a value of one. Every time a modified pulse width is used, and results in a decrease in performance, this variable (the "tuning status variable") is decremented by a value of one. The tuning status variable is used at the end of the tuning algorithm 121 in tuning step 15 to determine if an overall performance gain has occurred when using the modified pulse width for a particular iteration of the tuning algorithm 121, as implemented for a particular fuel map index. If the end result is increased performance, the modified pulse width is substituted into the fuel map, and replaces the base pulse width in the operational fuel map. The status map is updated to reflect the results of the self-tuning algorithm 121.

After step 0, a delay time is set. Step 1 (FIGS. 19 and 26), occurs at the first tachometer pulse after the delay. The methodology for the remaining steps is the same.

Thus, at tuning step 0 (FIGS. 19 and 26), an inquiry is made at step 405 to determine if engine revolution has just completed. If the answer is "yes," at step 407, the recording of tachometer pulse times is inhibited and the tuning status variables are cleared. At step 409, the base pulse width is obtained from the fuel map and the cell status is obtained from the status map. The pulse width is calculated using the base pulse width and the two temperature correction factors (inlet air temperature and engine coolant temperature). As noted previously, the fuel map is an array of base injector pulse values indexed on RPM ranges and manifold air pressure ranges. The status map is an array of values that is used to keep track of the tuning status of each point in the fuel map, i.e., is a particular pulse width value, tuned, interpolated or untuned. In addition, if a point is untuned the status map contains information on the tuning direction and percentage of increase or decrease to vary the pulse width to be used to tune the particular pulse width in the next tuning cycle at the particular load and engine speed. Thus, when the self-tuning cycle (15 steps) begins, the status map is consulted for the proper action. Each time a cycle of the self-tuning algorithm 121 is completed, a decision is made based upon the observed results and the value of the status map as to whether or not to continue tuning this point and, if so, whether to tune towards the rich or the leaner side. A value representing the decision is stored in the status map to be used in the next tuning cycle.

At step 411, it is determined if the point has been tuned and if the appropriate amount of time has elapsed since the last point was tuned. If the answer is "yes," the current point's cell status, i.e., a temporary value set up and equal to the value of a particular point in the status map to avoid having to continually index the status map, is set back to the default value at the status map in EEPROM 56 so that it will be retuned. A delay time of approximately two minutes is used.

At step 413, it is determined if the status indicates that the point has been fully tuned. If the answer is "yes," the tuning cycle is aborted and is inhibited for one second. If "no," the modified pulse width is calculated using the cell status as a guide. A delay is set to an appropriate number of tachometer pulses based upon a particular fuel map index, and the algorithm proceeds to tuning step 1 (FIGS. 19 and 26) on the next tachometer pulse. More particularly, at 413, the delay is used to give the engine time to react to a change in pulse width before any times for a series of tachometer pulses are recorded as shown in FIG. 26.

As can be seen, at the end of this operation, from step 413 it moves to step 500 to the end of the self-tuning algorithm (STA). After step 413, we then proceed to tuning step 1 (FIGS. 19 and 26). Tuning step 1 (FIGS. 19 and 26) is illustrated by step 415, which requires that the delay be decremented by one. At step 417, it is determined if the delay has reached zero. If the answer is "no," the subroutine proceeds to the end of the self-tuning algorithm at step 500. If it has reached zero, then an STA timed cycle is set to zero at step 419. There are four STA time cycles that are used to keep running totals of the time it takes for a set number of tachometer pulses to occur during the tuning algorithm. The first STA time cycle, i.e., time cycle zero, is set to zero at step 419, and recording of tachometer pulse times commences. A delay is set to allow recording of the time for an appropriate number of tachometer pulses to occur based upon the fuel map index. At the end of step 419, the next time self-tuning is to be conducted, it commences at tuning step 2 (FIGS. 19 and 26), as is self-explanatory from a reading of FIGS. 19–23 viewed with reference to FIG. 26. In step 419, the delay is used to indicate how many time samples are to be recorded. As can be appreciated from a reading of the block diagram of FIGS. 19–23, the algorithm 121 operates in an incremental manner through steps 500, with, at the completion of the next step, the next time tuning is implemented, it moves onto the following step to a maximum of 15 tuning steps (FIGS. 20–23 and 26).

It will be appreciated from FIGS. 19–23 and 26, that at tuning step 7, the time cycles corresponding to tuning steps 1 and 5 (time 0 and time 2) are averaged and compared to the time cycle corresponding to step 3 (time 1). If this average is less than the time cycle corresponding to step 3 (time 1), this means the engine slowed down when employing the modified pulse width. This indicates a degradation in performance. If this occurs, the tuning status variable is decremented by a value of one. If the average is greater, then the tuning status variable is incremented by a value of one.

At tuning step 11, the same methodology is followed using the average of the time cycles corresponding to tuning steps 5 and 9 (time 0 and time 2), and compared to the time corresponding to tuning step 7 (time 3). The tuning status variable is then decremented or incremented in the manner described above.

At tuning step 14, the average of time cycles corresponding to tuning steps 9 and 13 (time 0 and time 2), is compared to the time cycle corresponding to tuning step 11 (time 1). The tuning status variable is then decremented or incremented in the manner described above.

FIG. 24 illustrates the self-tuning algorithm pulse width determination routine 123 of the self-tuning algorithm 121. Step 519 begins the self-tuning algorithm pulse width determination. At step 521, the appropriate section is executed based upon the cell status as previously described. Depending upon the cell status, if the cell status code equals "rich 12," then pulse width adjustment towards the rich side is initially conducted at block 523. In block 523, ff the fuel map entry is greater than 14 milliseconds, the status map code entry is set equal to "lean 12," and an error code is set to indicate the injector nozzle size is too small, resulting in too large a pulse width. The modified pulse width for the tuning algorithm 121 iteration is equal to the base pulse reduced by 6%. If the answer is "no," the modified pulse width is the base pulse width increased by 6%. If set to "lean 12," as described above, block 525 shows that if the fuel map entry is less than 2.25 milliseconds, then the status map entry code is set equal to "tuned" and tuning is cancelled, an error code is set indicating the injector size is too big, thus resulting in too small a pulse width. If the answer is "no," then the modified pulse width is set equal to the base pulse width reduced by 6%. The adjustments are self-evident from a reading of the remaining steps of this Figure as described above. In this regard, it is important to appreciate that the fuel map is an array of base pulse width values indexed on RPM and manifold pressure as noted previously. Again, the status map is an array of values that is used to keep track of the tuning status of each point in the fuel map. When a self-tuning algorithm cycle (15 steps) begins, this table is consulted for the proper action. Each time a cycle of the self-tuning algorithm is completed, a decision is made based upon the observed results as to whether or not to continue tuning the point and, if so, whether to tune it in the rich or lean direction. A value representing this decision is stored in the table to be used in the next cycle.

FIG. 25 discloses a subroutine for the self-tuning algorithm decision steps 125 of FIG. 11, and is part of the self-tuning algorithm 121. It corresponds to step 499 of algorithm 121, and to tuning step 15. Subroutine 125 is started at step 501, leading to step 503 in which the appropriate section based upon the cell status before this tuning cycle is executed. In this regard, it is again noted that the cell status is the value in the status map for the engine load and speed at the beginning of the self-tuning algorithm tuning cycle. Based upon the cell status code for a particular tuning iteration, one of blocks 505–515 is executed. If the cell status code is set at "rich 12," the block 505 is executed. An inquiry is made as to whether the engine sped up indicated by a positive value of the tuned status variable. If the answer is "yes," 6% is added to the base pulse in the fuel map to replace the current fuel map entry. If the answer is "no," then the status map entry for this fuel map index will be set equal to "lean 12." At "lean 12," block 507 is executed. At block 507 an inquiry is made as to whether the engine slowed down. If the answer is "yes," 12% is added to the base pulse width in the fuel map. The status map entry is set to "tuned," and a signal is generated to start the curve fit routine 113. If the answer is "no," 6% is subtracted from the fuel map base pulse width. The status map is left at "lean 12." Similar adjustments are made in blocks 509–515, with varied adjustments in terms of the adjustment towards the lean or to the rich side as shown.

FIGS. 27–30 illustrate the subroutine of the analog-to-digital (A/D) service interrupt 109. Microcontrollers such as the Motorola MC68HC11F1 contain built-in circuitry to convert analog input signals to digital values based upon the analog voltage applied to input pins. The digital values will range from 0 to 255, with 0 representing zero volts and 255 representing five volts, with a linear scale in between. There are eight input channels and four output registers. In this system, each time the A/D service interrupt 109 occurs, four readings are taken on a selected one input channel, with the results being stored respectively in each one of four output registers.

The A/D service interrupt 109 begins at a step 601, and at step 603, the values of four analog-to-digital registers (A/D registers) are averaged and the results, i.e., average, saved. In this regard, it is important to appreciate that the analog-to-digital registers are illustrated in FIG. 4 as being part of the central processing unit having various input thereinto as shown respectively, at inputs 24, 26, 30, 32, 36, and 44 of FIG. 4.

At step 605, a determination is made whether this is the first reading on a particular sensor which is connected to the ECU 40. If the answer is "yes," at step 607 a determination is made as to which sensor is being read. These sensors are typically, a battery voltage sensor, engine temperature (coolant passage), intake air temperature, manifold absolute pressure, throttle position, and sensor reference voltage, as well as any other additional sensors which are desirable to implement in the system as will be readily apparent to those of ordinary skill in the art.

On the left side of the Figure, a reading is made and the appropriate one of the blocks 609–623 is executed, depending upon which sensor was read. For example, if sensor 0 is read, which corresponds to system voltage and block 609, this reading is accepted as an actual reading. After executing the appropriate instruction, the subroutine for each block respectively moves to step 711, in which the acceleration enrichment buffer is checked to see if there is any enrichment needed. If the answer is "yes," the enrichment is added to the pulse width and it is deleted from the buffer. In this regard, it is important to appreciate that the acceleration enrichment buffer is an array that is used to mimic the accelerator pump of a carburetor. If the throttle is opened quickly, extra fuel must be injected to compensate for the sudden change in manifold vacuum. The extra enrichment is added for a set amount of time. By taking advantage of the fact that this part of the subroutine occurs once every one millisecond, each element of the array can be used to store the enrichment for one unit of time following the initial throttle movement. This A/D service interrupt is conventional, well known to those of ordinary skill in the art, and can be implemented in various ways depending upon hardware selected. Sensors 1, 3, and 6 are primary sensors and read more frequently than others as shown. Sensors 0, 2, 4, 5, and 7 are less important and read less frequently. A different sensor is read each time this interrupt is executed. The primary sensors are read once every 4 milliseconds. The secondary sensors are read once every 20 milliseconds.

For each interrupt, a different sensor is read in accordance with the above-described convention. The first step for each is to add the average of the four registers to the sensor running total. The number of readings taken on that sensor is incremented. It is determined if enough readings have been taken on the particular sensor. If the answer is "yes," the average reading for the particular sensor is computed in the manner specified in the respective blocks 631, 641, 653, 663, 673, 683, 695, and 705. The running totals of the reading and the count of the readings for the particular sensor are then cleared and set to zero. With all sensor readings, a hysteresis has been built in to filter out noise and to prevent the sensor readings from oscillating between two values. This is done by requiring the sensor reading to increase by more than a threshold amount before it is considered to be a positive change. Any decrease is considered to be a negative change. The threshold amount is set between 2 and 5, on a scale between 0–255. This amount is essentially specific to the specific circuitry and CPU identified herein, and can vary with other hardware.

Irrespective of whether the answer at blocks 629, 639, 561, 661, 671, 681, 693, and 703 is "yes" or "no," for each particular sensor read, the next sensor to be read at the next interrupt is set according to setting for any one of blocks 635, 647, 657, 667, 677, 689, 699, and 709.

The only two additions to the above sequence is set forth with respect to the TPS (block 643) and engine temperature (block 687), as described hereafter.

Turning now to step 605, if this is not the first reading on each of the sensors, at step 625, a determination is made as to which sensor is being read. Depending upon the sensor as shown respectively at blocks 627, 637, 649, 659, 669, 679, 691, and 701, a series of steps are followed for each sensor as previously outlined. For example, if sensor 0 (voltage) is being read, beginning at block 627, the results are added to the running total of readings for that sensor, and the number of readings for this sensor is incremented. An inquiry is then made at step 629 as to whether 32 readings have been taken on this sensor, and if the answer is "yes," the average of the 32 readings is taken at step 631. At step 633 it is determined if the reading has increased significantly or decreased. If the answer is "yes," the results are said to equal the average divided by four and then the old average is set to the new average. It is noted that at step 633, the system voltage is sensed in order to ensure that the battery voltage is sufficient for proper operation of the injectors. Step 635 then sets the routine to look at the next sensor, in this case sensor 1, the TPS, on the next interrupt. The results are then passed to step 711, and the hardware is configured in step 719 to read the next sensor, i.e., the TPS, as described hereafter.

If the next interrupt, directs the reading to step 637, as noted above, this portion relates to the throttle position, i.e., the TPS, sensor. At step 643, the throttle position is sensed by the throttle position sensor. As with all sensor readings, again hysteresis has been built in to filter out noise and to prevent the sensor readings from oscillating between two values. The sensor reading is required to increase by more than a threshold amount before it is considered to be a positive change. Any decrease is considered to be a negative change. The threshold amount is between 2 and 5 on a scale of 0–255, as with respect to step 633 above. This amount is essentially specific to the particular circuitry and can vary with other hardware.

The acceleration enrichment buffer, set forth at step 643, is an array of values that is used to keep track of enrichment needed to compensate for quick opening of the throttle. Each element of the array represents the enrichment required for 10 milliseconds of an engine operation. If the throttle is opened quickly, an amount is added to each of the next several elements of the array. The amount of the increase is based upon the amount the throttle was opened. The value of the current pulse width and the position of the second switch.

If in the next interrupt, sensor 2 is read, steps 649 through 657 relate to the auxiliary sensor. This sensor is an available analog input that is not necessarily used, but is read anyway in order to keep the timing of the interrupt intact. At step 655, it is determined if the reading has increased significantly or decreased. As with all sensor readings, hysteresis is again built in to filter out noise and prevent sensor readings from oscillating between two values. This is done in the same manner as discussed above with reference to steps 633 and 643.

The determination at step 655 relates to the exhaust gas oxygen content, which is the amount of unused oxygen in the engine's exhaust. By sensing this value, it is possible to tell whether the engine is running rich or lean. While not necessary, this sensor may be used for racing purposes or for reducing exhaust emissions. Again, with respect to the above-other discussed sensors, hysteresis has been built in, in the same manner as described above. Beginning at steps 669 through 677, the air temperature is measured. The air temperature is the manifold air temperature and is sensed in order to compensate for air density. Again, as with all sensor readings, hysteresis has also been built in to filter out noise and prevent sensor readings from oscillating in the manner discussed above.

Steps 679 through 689 relate to the engine temperature which is the coolant temperature sensed in order to determine engine warm-up enrichment. The same hysteresis is built in as described above. The retune delay set forth in step 687 is a counter that is used to time the intervals between the retuning of points that have already been tuned. It takes advantage of the fact that this part of the interrupt routine happens once every 20 milliseconds, with a count of 1,000 equaling 20 seconds, and a count of 50,000 equalling 20 minutes, etc.

At steps 701 through 709, the reference voltage is detected. This is the voltage going to the sensors. If the voltage drops significantly, it indicates that there is a short in one of the sensor leads. This is used for diagnostic purposes. Hysteresis is built in the manner described above.

The actual sequence of sensors read is in the following order: 1, 3,6,0,1,3,6,2,1,3,6,4,1,3,6,5,1,3,6,7, as shown in FIGS. 27–30. This sequence is then continuously repeated. As can be appreciated, the primary sensors read most frequently are 1, 3, and 6.

Turning now to step 711, as discussed, the acceleration enrichment buffer is checked to see if there is enrichment needed.

Then step 713 determines whether the IAC delay counter has reached zero. If the answer is "no," the counter is decremented. The IAC delay is a counter that takes advantage of the fact that this part of the code occurs once every one millisecond. It is used to time delays in the IAC routine for the IAC valve to physically move a step and to allow the engine to respond. Thereafter, at step 715, a determination is made whether the inhibit STA counter for the self-tuning algorithm has reached zero. If the answer is "yes," and the IAC is not moving, then self-tuning is allowed to begin. The inhibit STA is a counter that takes advantage of the fact that this part of the subroutine occurs once every millisecond. It is used to time delays in the self-tuning while the engine reacts to changes in load, throttle position, etc. If the answer is "no," the counter is decremented at step 715 and self-tuning remains inhibited. Thereafter, switches, i.e., 16 position hex rotary switches or DIP switches, are read at step 717. The switches are user-adjustable inputs for the system as previously discussed. At step 719, the A/D circuitry is set to scan the next appropriate sensor and the next A/D interrupt is set to occur one millisecond from the time this interrupt occurred. The subroutine is then ended at step 721.

The Time Interrupt Routine 111 of the Electronic Control Unit Software 103 (FIG. 11) is shown in FIG. 31 and is now described herein. More specifically, because of the limit of the hardware that is used to implement the invention, it is impossible to obtain an accurate RPM reading when the engine speed is very low. This is caused by an overflow of the 16-bit timing registers. In order to obtain an accurate reading, the Time Interrupt Routine 111 is implemented. When an engine revolution has completed, a hardware interrupt is set to occur at a time coinciding with the overflow point of the system timer register (approximately 262 ms). The hardware interrupt causes the Timed Interrupt Routine 111 to be executed. After the interrupt is begun at step 801, the timed interrupt count is incremented at step 803, and the hardware interrupt is reset at step 805 to occur at a time coinciding with the next overflow of the system timer register. The Time Interrupt Routine 111 is then ended at step 807.

Having thus described the invention, the same will become better understood from the appended claims, in which it is described, and intended to be described, in a broad and non-limiting manner.

What is claimed is:

1. A method for controlling an electronic fuel delivery system, comprising:

a) running an engine by at least injecting fuel into said engine in fuel pulse width amounts for specific pairs of engine operating parameters corresponding to fuel pulse widths in an initial fuel map, said initial fuel map defining a plurality of fuel pulse widths for corresponding pairs of defined engine operating parameters;

b) adjusting fuel pulse width at least one increment in one of a rich and a lean direction of operation for a specific pair of engine operating parameters, determining if engine performance is one of improved, not improved, and degraded after each adjustment, and if improvement is detected continuing said adjustment until one of no improvement and degradation in performance is detected;

c) reversing direction of adjustment at least one increment when degradation in performance is detected; and d) repeating said steps "a" through "c" for any additional pairs of engine parameters at which said engine is operated.

2. The method as in claim 1 wherein said pairs of engine parameters detected are engine speed and manifold air pressure, and said detected parameter indicative of said engine performance is a change in torque as reflected by at least a detected change in one of engine speed and acceleration.

3. The method as in claim 1 wherein pulse width adjustment in step "b" is initially done in the rich direction.

4. The method as in claim 1 further comprising adjusting fuel pulse widths of operation by correction factors determined in accordance with detected at least one of air temperature, engine temperature and battery voltage.

5. The method as in claim 1 further comprising:

indicating whether said specific pair of engine operating parameter is instantaneously tuned to allow an operator to seek out untuned operational ranges by changing throttle position.

6. The method as in claim 1 further comprising interpolating value for all untuned pairs of engine operating parameters between two or more tuned pairs of engine operating parameters within a predetermined range to obtain interpolated values for each untuned pair of engine operating parameters, and replacing said untuned pulse widths with said interpolated values resulting in an interpolated state for said pairs of engine operating parameters with interpolated values, thereby providing a smooth transition from the lowest to the highest tuned pairs of engine operating parameters.

7. A method for controlling an electronic fuel delivery system, comprising:

a) running an engine by at least injecting fuel into said engine in fuel pulse width amounts for specific pairs of engine operating parameters corresponding to fuel pulse widths in an initial fuel map, said initial fuel map defining a plurality of fuel pulse widths for corresponding pairs of defined engine operating parameters;

b) adjusting said pulse width at least one increment in one of a rich and a lean direction of operation for specific pair of engine operating parameters, determining if engine performance is one of improved, not improved, and degraded after each adjustment, and if improvement is detected continuing said adjustment until one of no improvement and a degradation in performance is detected;

c) adjusting said pulse width at least one increment in a reverse direction for said specific pair of engine operating parameters when at least one of no improvement and a degradation in performance is detected in step "b"; and determining if engine performance is one of improved, not improved, and degraded after each adjustment, and if improvement is detected continuing said adjustment for said specific pair of engine operating parameters until one of no improvement and a degradation in performance is detected:

d) adjusting said pulse width at least one increment in a reverse direction for said specific pair of engine operating parameters when at least one of no improvement and a degradation in performance is detected in step "c" resulting in a tuned state for said specific pair of engine operating parameters; and e) repeating said steps "a" through "d" for any additional pairs of engine parameters at which said engine is operated.

8. The method as in claim 7 wherein said pairs of engine parameters detected are engine speed and manifold air pressure, and said detected parameter indicative of said engine performance is change in torque as reflected by at least a detected change in one of engine speed and acceleration.

9. The method as in claim 7 further comprising;

indicating whether said specific pair of engine operating parameter is instantaneously tuned to allow an operator to seek out untuned operational ranges by changing throttle position.

10. The method as in claim 7 further comprising interpolating values for all untuned pairs of engine operating parameters between two or more tuned pairs of engine operating parameters within a predetermined range to obtain interpolated values for each untuned pair of engine operating parameters, and replacing said untuned pulse widths with said interpolated values resulting in an interpolated state for said pairs of engine operating parameters with interpolated values, thereby providing a smooth transition from the lowest to the highest tuned pairs of engine operating parameters.

11. The method as in claim 7 further comprising;

updating a status value in a status map whenever said pulse width of said specific pair of engine operating parameters is changed; and checking said status value in said status map of said specific pair of engine operating parameters prior to step "b" of claim 1 to determine whether to continue tuning said specific pair of engine operating parameters based on the status value.

12. The method as in claim 11 wherein said status value comprises at least one of tuned, untuned, and interpolated, and if said value is tuned, said status value further comprising tuning direction and percentage change.

13. The method as in claim 7 further comprising:

temporarily stopping said adjustment of said pulse width upon reaching said tuned state for said specific pair of engine operating parameters;

matching adjusted pulse widths to corresponding ones of fuel pulse widths in a plurality of template fuel maps to determine the closest match to said adjusted fuel pulse widths; and creating an operational fuel map for operating said engine by replacing unadjusted pulse widths with those of the closest matched template fuel map.

14. The method as in claim 13 wherein said matching is conducted by adding sufficient pulse width size to every point in the template fuel map compared to result in an adjusted template fuel map for each one of said plurality of template fuel maps so that every point in the adjusted template fuel map compared is equal to or greater than the corresponding point of the operational fuel map; obtaining the total variance between each adjusted template fuel map and the initial fuel map; and operating the engine in accordance with the adjusted template fuel map having the less total variance from the initial fuel map.

15. The method as in claim 13 further comprising adjusting fuel pulse widths of operation by correction factors determined in accordance with detected at least one of air temperature, engine temperature and battery voltage.

16. The method as in claim 13 further comprising:

determining whether any fuel pulse widths are below or above a predetermined range and replacing any of said fuel pulse widths which are below or above said predetermined range with predetermined values in said operational fuel map.

17. The method as in claim 13 further comprising:

saving said operational fuel map when power to the electronic fuel delivery system is discontinued.

18. The method as in claim 16 wherein said predetermined range is substantially in the range of 2 milliseconds to 15 milliseconds.

19. An apparatus for controlling an electronic injector fuel delivery system, comprising:

means for controlling fuel pulse widths for fuel being fed to a running engine in accordance with an initial stored fuel map correlating fuel pulse widths to respective pairs of a plurality of pairs of engine operating parameters;

means for adjusting said fuel pulse width at least one increment for a pair of engine operating parameters at which said engine is operating in one of a rich and a lean direction of operation, means for receiving input from a detector for detecting at least one of whether engine performance improves does not improve and degrades upon each pulse width adjustment, and including means for causing said means for adjusting to reverse direction of adjustment upon one of no improvement and a degradation being detected; and means for causing reversal of said adjustment at least one increment upon a degradation being detected after adjustments being done in said reversed direction.

20. The apparatus as in claim 19 further comprising means for receiving inputs indicative of engine speed and manifold air pressure as said respective pairs of engine operating parameters associated with corresponding fuel pulse widths.

21. The apparatus as in claim 19 wherein said means for adjusting is for initially adjusting in the rich direction of operation.

22. The apparatus as in claim 19 further comprising at least one of means for detecting at least one of air temperature, engine temperature, and battery voltage during engine operation; and means for adjusting each fuel pulse width in accordance with a predetermined correction factor corresponding to detected at least one of air temperature, engine temperature, and battery voltage.

23. The apparatus as in claim 19 further comprising:

means for indicating whether said specific pair of engine operating parameter is instantaneously tuned to allow an operator to seek out untuned operational ranges by changing throttle position.

24. The apparatus as in claim 19 further comprising means for interpolating values for all untuned pairs of engine operating parameters between two or more tuned pairs of engine operating parameters within a predetermined range to obtain interpolated values for each untuned pair of engine operating parameters, and means for replacing said untuned pulse widths with said interpolated values resulting in an interpolated state for said pairs of engine operating parameters with interpolated values, thereby providing a smooth transition from the lowest to the highest tuned pairs of engine operating parameters.

25. An apparatus for controlling an electronic injector fuel delivery system, comprising:

means for controlling fuel pulse widths for fuel being fed to a running engine, in accordance with an initial stored fuel map correlating fuel pulse widths to respective pairs of a plurality of pairs of engine operating parameters;

means for adjusting aid fuel pulse width at least one increment for a pair of engine operating parameters at which said engine is operating, in one of a rich and a lean direction of operation;

means for receiving input from a detector for detecting at least one of whether engine performance improves, does not improve and degrades upon each pulse width adjustment;

means for continuing adjusting said fuel pulse width at least one increment for said pair of engine operating parameters as long as said detector detects improvement, until said detector detects one of no improvement or degradation;

means for causing said means for adjusting to adjust said fuel pulse width at least one increment in a reverse direction for a pair of engine operating parameters upon one of no improvement and a degradation being detected; and means for continuing adjusting said fuel pulse width at least one increment for said pair of engine operating parameters as long as said detector detects improvement, until said detector detects one of no improvement or degradation;

means for causing said means for adjusting to adjust said fuel pulse width at least one increment in a reverse direction for a pair of engine operating parameters upon a degradation being detected resulting in a tuned state for said specific pair of engine operating parameters.

26. The apparatus as in claim 25 further comprising:

means for indicating whether said specific pair of engine operating parameter is instantaneously tuned to allow an operator to seek out untuned operational ranges by changing throttle position.

27. The apparatus as in claim 25 further comprising:

means for updating a status value in a status map whenever said pulse width of said specific pair of engine operating parameters is changed; and means for checking said status value in said status map of said specific pair of engine operating parameters prior to adjusting pulse width to determine whether to continue tuning said specific pair of engine operating parameters based on the status value.

28. The apparatus as in claim 27 wherein said status value comprises at least one of tuned, untuned, and interpolated; and, if said value is tuned, said status value further comprising tuning direction and percentage change.

29. The apparatus as in claim 25 further comprising means for interpolating values for all untuned pairs of engine operating parameters between two or more tuned pairs of engine operating parameters within a predetermined range to obtain interpolated values for each untuned pair of engine operating parameters, and means for replacing said untuned pulse widths with said interpolated values resulting in an interpolated state for said pairs of engine operating parameters with interpolated values, thereby providing a smooth transition from the lowest to the highest tuned pairs of engine operating parameters.

30. The apparatus as in claim 25 further comprising:

means for temporarily stopping tuning of pulse widths upon reaching said tuned state for said specific pair of engine operating parameters;

comparing means for comparing all previously adjusted fuel pulse widths to corresponding fuel pulse widths in respective ones of a plurality of template fuel maps for determining the closest fuel map to said tuned fuel pulse widths; and means for creating a new fuel map for operating said engine corresponding the closest matched template fuel map and all previously adjusted points, with said new fuel map being an operational fuel map for running said engine.

31. The apparatus as in claim 30 further comprising:

variance determining means for matching said template fuel maps to said tuned fuel pulse widths by adding sufficient pulse width size to every point in each template fuel map compared to result in an adjusted template fuel map for each compared so that every point in each adjusted template fuel map compared is equal to or greater than the corresponding point of the operational fuel map;

means for obtaining the total variance between each adjusted template fuel map and the initial fuel map; and means for causing the engine to be operated in accordance with the operational fuel map, said operational fuel map being comprised of all previously tuned points and others obtained from the template fuel map having the least total variance from the previously tuned points.

32. The apparatus as in claim 30 further comprising at least one of means for detecting at least one of air temperature, engine temperature, and battery voltage during engine operation; and means for adjusting each fuel pulse width in accordance with a predetermined correction factor corresponding to detected at least one of air temperature, engine temperature, and battery voltage.

33. The apparatus as in claim 30 further comprising:

means for determining whether any fuel pulse widths are below or above a predetermined range and means for replacing any of said fuel pulse widths which are below or above said predetermined range with predetermined values in said operational fuel map.

34. The apparatus in claim 33 wherein said predetermined range is substantially in the range of 2 milliseconds to 15 milliseconds.

35. The apparatus as in claim 30 further comprising:

means for saving said operational fuel map when power to the electronic fuel delivery system is discontinued.

36. A method for adjusting a fuel pulse width of a specific pair of engine operating parameters to improve performance, comprising the steps of:

a) adjusting said fuel pulse width at least one increment in one of a rich and a lean direction of operation for said specific pair of engine operating parameters;

b) determining if engine performance is one of improved, not improved, and degraded;

c) if improved, repeat steps "a" through "c", and if not improved or degraded, go to step "d";

d) adjusting said fuel pulse width at least one increment in a reverse direction;

e) determining if engine performance is one of improved, not improved, and degraded;

f) if improved, repeat steps "d" through "f", and if not improved or degraded, go to step "g"; and g) adjusting said fuel pulse width at least one increment in a reverse direction resulting in a tuned state for said specific pair of engine operating parameters.

37. The method as in claim 36 further comprising:

repeating steps "a" through "g" for any additional pairs of engine operating parameters for which an engine is operated.

38. The method of claim 36 further comprising:

updating a status value in a status map whenever said pulse width of said specific pair of engine operating parameters is changed; and checking said status value in said status map of said specific pair of engine operating parameters prior to step "a" of claim 29 to determine whether to perform or skip steps "a" through "g" based on the status value.

39. The method of claim 36 further comprising:

interpolating values for all untuned pairs of engine operating parameters between two or more tuned pairs of engine operating parameters within a predetermined range to obtain interpolated values for each untuned pair of engine operating parameters, and replacing said untuned pulse widths with said interpolated values resulting in an interpolated state for said pairs of engine operating parameters with interpolated values, thereby providing a smooth transition from the lowest to the highest tuned pairs of engine operating parameters.

40. The method of claim 36 further comprising:

temporarily stopping said adjustment of said pulse width upon reaching said tuned state for said specific pair of engine operating parameters;

matching adjusted pulse widths to corresponding ones of fuel pulse widths in a plurality of template fuel maps to determine the closest match to said adjusted fuel pulse widths; and creating an operational fuel map for operating said engine by replacing unadjusted pulse widths with those of the closest matched template fuel map.

* * * * *